US008458887B2

(12) United States Patent
Wagstaff et al.

(10) Patent No.: US 8,458,887 B2
(45) Date of Patent: Jun. 11, 2013

(54) HOMOGENIZATION AND HEAT-TREATMENT OF CAST METALS

(75) Inventors: Robert Bruce Wagstaff, Green Acres, WA (US); Wayne J. Fenton, Spokane, WA (US)

(73) Assignee: Novelis Inc., Toronto, Ontario (CA)

( * ) Notice: Subject to any disclaimer, the term of this patent is extended or adjusted under 35 U.S.C. 154(b) by 0 days.

(21) Appl. No.: 12/927,519

(22) Filed: Nov. 16, 2010

(65) Prior Publication Data

US 2011/0079329 A1 Apr. 7, 2011

Related U.S. Application Data

(62) Division of application No. 12/380,487, filed on Feb. 27, 2009, now Pat. No. 7,871,478, which is a division of application No. 11/588,517, filed on Oct. 27, 2006, now Pat. No. 7,516,775.

(60) Provisional application No. 60/731,124, filed on Oct. 28, 2005, provisional application No. 60/733,943, filed on Nov. 3, 2005, provisional application No. 60/794,600, filed on Apr. 25, 2006.

(51) Int. Cl.
*B21B 1/46* (2006.01)
*B21B 27/06* (2006.01)

(52) U.S. Cl.
USPC ..... 29/527.7; 29/527.5; 72/200

(58) Field of Classification Search
USPC ..... 164/487, 444; 29/527.7, 527.5, 527.1; 72/200, 365.2
See application file for complete search history.

(56) References Cited

U.S. PATENT DOCUMENTS

| | | | | | |
|---|---|---|---|---|---|
| 2,705,353 | A | * | 4/1955 | Zeigler | 164/487 |
| 2,708,297 | A | * | 5/1955 | Zeigler | 164/444 |
| 3,763,921 | A | * | 10/1973 | Behr et al. | 164/487 |
| 3,891,024 | A | | 6/1975 | Gervais et al. | |
| 3,908,737 | A | * | 9/1975 | Matsunaga et al. | 164/476 |
| 3,938,991 | A | | 2/1976 | Sperry et al. | |

(Continued)

FOREIGN PATENT DOCUMENTS

| | | | |
|---|---|---|---|
| EP | 0 613 959 | A1 | 9/1994 |
| EP | 0 616 044 | A2 | 9/1994 |

(Continued)

OTHER PUBLICATIONS

English translation of JP 55-49856 (Apr. 1, 1980).

(Continued)

*Primary Examiner* — Essama Omgba
(74) *Attorney, Agent, or Firm* — Cooper & Dunham LLP

(57) ABSTRACT

A method of casting a metal ingot with a microstructure that facilitates further working, such as hot and cold rolling. The metal is cast in a direct chill casting mold, or the equivalent, that directs a spray of coolant liquid onto the outer surface of the ingot to achieve rapid cooling. The coolant is removed from the surface at a location where the emerging embryonic ingot is still not completely solid, such that the latent heat of solidification and the sensible heat of the molten core raises the temperature of the adjacent solid shell to a convergence temperature that is above a transition temperature for in-situ homogenization of the metal. A further conventional homogenization step is then not required. The invention also relates to the heat-treatment of such ingots prior to hot working.

9 Claims, 35 Drawing Sheets

U.S. PATENT DOCUMENTS

| | | | | |
|---|---|---|---|---|
| 3,966,506 | A | 6/1976 | Mandigo et al. | |
| 4,077,810 | A * | 3/1978 | Ohuchi et al. | 148/552 |
| 5,104,459 | A | 4/1992 | Chen et al. | |
| 5,431,214 | A * | 7/1995 | Ohatake et al. | 164/444 |
| 6,736,911 | B1 * | 5/2004 | Ro et al. | 148/437 |
| 7,516,775 | B2 * | 4/2009 | Wagstaff et al. | 164/487 |
| 7,732,059 | B2 * | 6/2010 | Ren et al. | 428/654 |
| 7,871,478 | B2 * | 1/2011 | Wagstaff et al. | 148/551 |
| 2003/0005984 | A1 | 1/2003 | Oyama et al. | |
| 2006/0118282 | A1 * | 6/2006 | Ren et al. | 165/133 |
| 2010/0084109 | A1 * | 4/2010 | Gildemeister et al. | 164/487 |

FOREIGN PATENT DOCUMENTS

| | | | |
|---|---|---|---|
| EP | 0 646 655 | A1 | 4/1995 |
| EP | 1 106 381 | A1 | 6/2001 |
| JP | 55-049856 | | 9/1953 |
| JP | A 54-016335 | | 2/1979 |
| JP | A 63-144846 | A2 | 6/1988 |
| JP | 3 166344 | A | 7/1991 |
| JP | A 05-177308 | | 7/1993 |
| JP | A 09-122860 | | 5/1997 |
| JP | A 2001-191150 | | 7/2001 |
| JP | A 2003-034835 | | 2/2003 |
| JP | A 2005-506908 | | 3/2005 |
| SU | 908487 | | 2/1982 |
| WO | WO 02/090609 | A1 | 11/2002 |
| WO | WO 03/035305 | A1 | 5/2003 |

OTHER PUBLICATIONS

English translation of JP 2001-191150 (Jul. 17, 2001).

English translation of JP 54-16335 (Feb. 6, 1979).

English translation of JP 5-177308 (Jul. 20, 1993).

English translation of JP 9-122860 (May 13, 1997).

Hatch, J.E., "Aluminum", Jan. 1, 1987, Aluminum: Properties and Physical Metallurgy, Ohio, American Society for Metals, US, pp. 134-183, XP002161802.

"International Alloy Designations and Chemical Composition Limits for Wrought Aluminum and Wrought Aluminum Alloys", Apr. 1, 2004, pp. 1-35, XP003023672.

Partial European Search Report, Feb. 7, 2011, EP 10010441.3, Novelis Inc.

European Patent Office, extended search report (Mar. 14, 2012), Appln No. 1001044035-2122/2283949 (Novelis Inc.).

European Patent Office, Extended European Search Report (Jun. 8, 2012), Application No. 11183266.3-2122 (Novelis Inc.).

* cited by examiner

In-situ Al-4.5% Cu with rebound temperature of 300°C. Quarter position (FE4628)

HOMOGENIZATION AND HEAT-TREATMENT OF CAST METALS

CROSS-REFERENCE TO RELATED APPLICATIONS

This application is a division under 35 U.S.C. §120 of our U.S. patent application Ser. No. 12/380,487 filed Feb. 27, 2009 (now U.S. Pat. No. 7,871,478), which is a division under 35 U.S.C. §120 of our U.S. patent application Ser. No. 11/588,517 filed Oct. 27, 2006 (now U.S. Pat. No. 7,516,775), which claims the priority rights of our prior U.S. provisional patent application Ser. Nos. 60/731,124 filed Oct. 28, 2005, 60/733,943 filed Nov. 3, 2005 and 60/794,600 filed Apr. 25, 2006. The disclosures of each of these prior applications are specifically incorporated herein by reference.

BACKGROUND OF THE INVENTION

I. Field of the Invention

This invention relates to the casting of metals, particularly metal alloys, and their treatment to make them suitable to form metal products such as sheet and plate articles.

II. Background Art

Metal alloys, and particularly aluminum alloys, are often cast from molten form to produce ingots or billets that are subsequently subjected to rolling, hot working, or the like, to produce sheet or plate articles used for the manufacture of numerous products. Ingots are frequently produced by direct chill (DC) casting, but there are equivalent casting methods, such as electromagnetic casting (e.g. as typified by U.S. Pat. Nos. 3,985,179 and 4,004,631, both to Goodrich et al.), that are also employed. The following discussion relates primarily to DC casting, but the same principles apply all such casting procedures that create the same or equivalent microstructural properties in the cast metal.

DC casting of metals (e.g. aluminum and aluminum alloys—referred to collectively in the following as aluminum) to produce ingots is typically carried out in a shallow, open-ended, axially vertical mold which is initially closed at its lower end by a downwardly movable platform (often referred to as a bottom block). The mold is surrounded by a cooling jacket through which a cooling fluid such as water is continuously circulated to provide external chilling of the mold wall. The molten aluminum (or other metal) is introduced into the upper end of the chilled mold and, as the molten metal solidifies in a region adjacent to the inner periphery of the mold, the platform is moved downwardly. With an effectively continuous movement of the platform and correspondingly continuous supply of molten aluminum to the mold, an ingot of desired length may be produced, limited only by the space available below the mold. Further details of DC casting may be obtained from U.S. Pat. No. 2,301,027 to Ennor (the disclosure of which is incorporated herein by reference), and other patents.

DC casting can also be carried out horizontally, i.e. with the mold oriented non-vertically, with some modification of equipment and, in such cases, the casting operation may be essentially continuous. In the following discussion, reference is made to vertical direct chill casting, but the same principles apply to horizontal DC casting.

The ingot emerging from the lower (output) end of the mold in vertical DC casting is externally solid but is still molten in its central core. In other words, the pool of molten metal within the mold extends downwardly into the central portion of the downwardly-moving ingot for some distance below the mold as a sump of molten metal. This sump has a progressively decreasing cross-section in the downward direction as the ingot solidifies inwardly from the outer surface until its core portion becomes completely solid. The portion of the cast metal product having a solid outer shell and a molten core is referred to herein as an embryonic ingot which becomes a cast ingot when fully solidified.

As an important feature of the direct chill casting process, a continuously-supplied coolant fluid, such as water, is brought into direct contact with the outer surface of the advancing embryonic ingot directly below the mold, thereby causing direct chilling of the surface metal. This direct chilling of the ingot surface serves both to maintain the peripheral portion of the ingot in solid state and to promote internal cooling and solidification of the ingot.

Conventionally, a single cooling zone is provided below the mold. Typically, the cooling action in this zone is effected by directing a substantially continuous flow of water uniformly along the periphery of the ingot immediately below the mold, the water being discharged, for example, from the lower end of the mold cooling jacket. In this procedure, the water impinges with considerable force or momentum onto the ingot surface at a substantial angle thereto and flows downwardly over the ingot surface with continuing but diminishing cooling effect until the ingot surface temperature approximates that of the water.

Typically, the coolant water, upon contacting the hot metal, first undergoes two boiling events. A film of predominately water vapor is formed directly under the liquid in the stagnant region of the jet and immediately adjacent to this, in the close regions above, to either side and below the jet, classical nucleate film boiling occurs. As the ingot cools, and the nucleation and mixing effect of the bubbles subsides, fluid flow and thermal boundary layer conditions change to forced convection down the bulk of the ingot until, eventually, the hydrodynamic conditions change to simple free falling film across the entire surface of the ingot in the lowermost extremities of the ingot.

Direct chill cast ingots produced in this way are generally subjected to hot and cold rolling steps, or other hot-working procedures, in order to produce articles such as sheet or plate of various thicknesses and widths. However, in most cases a homogenization procedure is normally required prior to rolling or other hot-working procedure in order to convert the metal to a more usable form and/or to improve the final properties of the rolled product. Homogenization is carried out to equilibrate microscopic concentration gradients. The homogenization step involves heating the cast ingot to an elevated temperature (generally a temperature above a transition temperature, e.g. a solvus temperature of the alloy, often above 450° C. and typically (for many alloys) in the range of 500 to 630° C.) for a considerable period of time, e.g. a few hours and generally up to 30 hours.

The need for this homogenization step is a result of the microstructure deficiencies found in the cast product resulting from the early stages or final stages of solidification. On a microscopic level, the solidification of DC cast alloys are characterized by five events: (1) the nucleation of the primary phase (whose frequency may or many not be associated with the presence of a grain refiner); (2) the formation of a cellular, dendritic or combination of cellular and dendritic structures that define a grain; (3) the rejection of solute from the cellular/dendritic structure due to the prevailing non-equilibrium solidification conditions; (4) the movement of the rejected solute that is enhanced by the volume change of the solidifying primary phase; and (5) the concentration of rejected solute and its solidification at a terminal reaction temperature (e.g. eutectic).

The resulting structure of the metal is therefore quite complex and is characterized by compositional variances across not only the grain but also in the regions adjacent to the intermetallic phases where relatively soft and hard regions co-exist in the structure and, if not modified or transformed, will create final gauge property variances unacceptable to the final product.

Homogenization is a generic term generally used to describe a heat treatment designed to correct microscopic deficiencies in the distribution of solute elements and (concomitantly) modify the intermetallic structures present at the interfaces. Accepted results of a homogenization process include the following:

1. The elemental distribution within a grain becomes more uniform.
2. Any low melting point constituent particles (e.g. eutectics) that formed at the grain boundaries and triple points during casting are dissolved back into the grains.
3. Certain intermetallic particles (e.g. peritectics) undergo chemical and structural transformations.
4. Large intermetallic particles (e.g. peritectics) that form during casting may be fractured and rounded during heat-up.
5. Precipitates (such as may be used to subsequently developed to strengthen the material) are formed during heat-up are dissolved and later precipitated evenly across the grain after dissolution and redistribution as the ingot is once again cooled below the solvus and either held at a constant temperature and allowed to nucleate and grow, or cooled to room temperature and preheated to hot working temperatures.

In some cases, it is necessary to apply thermal treatments to ingots during the actual DC casting process to correct differential stress fields induced during the casting process. Those skilled in the art characterize alloys into those that either crack post-solidification or pre-solidification in response to these stresses.

Post-solidification cracks are caused by macroscopic stresses that develop during casting, which cause cracks to form in a trans-granular manner after solidification is complete. This is typically corrected by maintaining the ingot surface temperature (thus decreasing the temperature—hence strain—gradient in the ingot) at an elevated level during the casting process and by transferring conventionally cast ingots to a stress relieving furnace immediately after casting.

Pre-solidification cracks are also caused by macroscopic stresses that develop during casting. However, in this case, the macroscopic stresses formed during solidification are relieved by tearing or shearing the structure, inter-granularly, along low melting point eutectic networks (associated with solute rejection on solidification). It has been found that equalizing, from center to surface, the linear temperature gradient differential (i.e. the temperature derivative surface to center of the emerging ingot) can successfully mitigate such cracking.

These defects render the ingot unacceptable for many purposes. Various attempts have been made to overcome this problem by controlling the surface cooling rate of an ingot during casting. For instance, in alloys prone to post-solidification cracking, Zeigler, in U.S. Pat. No. 2,705,353, used a wiper to remove coolant from the surface of the ingot at a distance below the mold so that the internal heat of the ingot would reheat the cooled surface. The intention was to maintain the temperature of the surface at a level above about 300° F. (149° C.) and, preferably, within a typical annealing range of about 400 to 650° F. (204 to 344° C.).

Zinniger, in U.S. Pat. No. 4,237,961, showed another direct chill casting system with a coolant wiping device in a form of an inflatable, elastomeric wiping collar. This served the same basic purpose as that described in the above Zeigler patent, with the surface temperature of the ingot being maintained at a level sufficient to relieve internal stresses. In the example of the Zinniger patent, the ingot surface is maintained at a temperature of approximately 500° F. (260° C.), which is again in the annealing range. The purpose of this procedure was to permit the casting of ingots of very large cross section by preventing the development of excessive thermal stresses within the ingot.

In pre-solidification crack prone alloys, Bryson, in U.S. Pat. No. 3,713,479, used two levels of water spray cooling of lesser intensity to decrease the cooling rate and have it extend a greater distance down the ingot as the ingot descends and, as a result of this work, demonstrated the capability to increase overall casting rates realized in the process.

Another design of direct chill casting device using a wiper for removing cooling water is shown in Ohatake et al. in Canadian Patent 2,095,085. With this design, primary and secondary water cooling jets are used, followed by a wiper to remove water, with the wiper being followed by a third cooling water jet.

SUMMARY OF THE INVENTION

An exemplary form or aspect is based on observation that metallurgical properties equivalent or identical to those produced during conventional homogenization of a cast metal ingot (a procedure requiring several hours of heating at an elevated temperature) can be imparted to such an ingot by allowing the temperatures of the cooled shell and still-molten interior of an embryonic cast ingot to converge to a temperature at or above a transformation temperature of the metal at which in-situ homogenization of the metal occurs, which is generally a temperature of at least 425° C. for many aluminum alloys, and preferably to remain at or near that temperature for a suitable period of time for the desired transformations to occur (at least in part).

Surprisingly, desirable metallurgical changes can often be imparted in this way in a relatively short time (e.g. 10 to 30 minutes) and the procedure for achieving such a result can be incorporated into the casting operation itself, thereby avoiding the need for an additional expensive and inconvenient homogenizing step. Without wishing to be bound by any particular theory, it is possible that this is because desirable metallurgical changes are created or maintained as the alloy is being cast by a significant backward-diffusion effect (in either, or both, solid and liquid states and their combined 'mushy' form) for a short period of time rather than having undesirable metallurgical properties form during conventional cooling, that then require considerable time for correction in a conventional homogenization step.

Even in those cases where homogenization is not normally carried out with a conventionally cast ingot, there can be gains in properties that make the ingot easier to process or provide a product with improved properties.

The method of casting involving in-situ homogenization as set out above may optionally be followed by a quenching operation before the ingot is removed from the casting apparatus, e.g. by immersing the leading part of the advancing cast ingot into a pool of coolant liquid. This is carried out following the removal of the coolant liquid supplied to the surface of the embryonic ingot and after sufficient time has been allowed for suitable metallurgical transformations.

The term "in-situ homogenization" has been coined by the inventors to describe this phenomenon whereby microstructural changes are achieved during the casting process that are equivalent to those obtained by conventional homogenization carried out following casting and cooling. Similarly, the term "in-situ quench" has been coined to describe a quenching step carried out after in-situ homogenization during the casting process.

It is to be noted that embodiments may be applied to the casting of composite ingots of two or more metals (or the same metal from two different sources), e.g. as described in U.S. patent publication 2005-0011630 published on Jan. 20, 2005 or U.S. Pat. No. 6,705,384 which issued on Mar. 16, 2004. Composite ingots of this kind are cast in much the same way as monolithic ingots made of one metal, but the casting mold or the like has two or more inlets separated by an internal mold wall or by a continuously-fed a strip of solid metal that is incorporated into the cast ingot. Once leaving the mold, through one or more outlets, the composite ingot is subjected to liquid cooling and the liquid coolant may be removed in the same way as for a monolithic ingot with the same or an equivalent effect.

Thus, certain exemplary embodiments can provide a method of casting a metal ingot, comprising the steps of: (a) supplying molten metal from at least one source to a region where the molten metal is peripherally confined, thereby providing the molten metal with a peripheral portion; (b) cooling the peripheral portion of the metal, thereby forming an embryonic ingot having an external solid shell and an internal molten core; (c) advancing the embryonic ingot in a direction of advancement away from the region where the molten metal is peripherally confined while supplying additional molten metal to the region, thereby extending the molten core contained within the solid shell beyond the region; (d) cooling an outer surface of the embryonic ingot emerging from the region where the metal is peripherally confined by directing a supply of coolant liquid onto the outer surface; and (e) removing an effective amount (and, most preferably, all) of the coolant liquid from the outer surface of the embryonic ingot at a location on the outer surface of the ingot where a cross section of the ingot perpendicular to the direction of advancement intersects a portion of the molten core such that internal heat from the molten core reheats the solid shell adjacent to the molten core after removing the effective amount of coolant, thereby causing temperatures of the core and shell to each approach a convergence temperature of 425° C. or higher.

This convergence can, in preferred cases, be tracked by measuring the outside surface of the ingot which shows a temperature rebound after the coolant liquid has been removed. This rebound temperature should peak above the transformation temperature of the alloy or phase, and preferably above 426° C.

In the above method, the molten metal in step (a) is preferably supplied to at least one inlet of a direct chill casting mold, the direct chill casting mold thereby forming the region where the molten metal is peripherally confined, and the embryonic ingot is advanced in step (c) from at least one outlet of the direct chill casting mold, with the location on the outer surface of the ingot where the substantial portion of coolant liquid is removed in step (e) being spaced by a distance from the at least one outlet of the mold. The casting method (i.e. supply of molten metal) may be continuous or semi-continuous, as desired.

The coolant liquid may be removed from the outer surface by wiping or other means. Preferably, a wiper encircling the ingot is provided and the position of the wiper may be varied, if desired, during different phases of the casting operation, e.g. to minimize differences of the convergence temperature that may otherwise occur during such different phases.

According to another exemplary embodiment, there is provided apparatus for continuously or semi-continuously direct chill casting a metal ingot, comprising: a casting mold having at least one inlet, at least one outlet and at least one mold cavity; at least one cooling jacket for the at least one mold cavity; a supply of coolant liquid arranged to cause the coolant liquid to flow along an exterior surface of an embryonic ingot emerging from the at least one outlet; means spaced at a distance from the at least one outlet for removing the coolant liquid from the exterior surface of the embryonic ingot; and apparatus for moving the coolant removing means towards and away from the at least one outlet, thereby enabling the distance to be modified during casting of the ingot.

Another exemplary embodiment provides a method of producing a metal sheet article, which includes producing a solidified metal ingot by a method as described above; and hot-working the ingot to produce a worked article; wherein the hot-working is carried out without homogenization of the solidified metal ingot between the ingot-producing step (a) and the hot-working step (b). The hot-working may be, for example, hot-rolling, and this may be followed by conventional cold-rolling, if desired. The term "hot-working" may include, for example, such process as hot-rolling, extrusion and forging.

Another exemplary embodiment provides a method of producing a metal ingot that can be hot-worked without prior homogenization, which method comprises casting a metal to form an ingot under conditions of temperature and time effective to produce a solidified metal having a non-cored microstructure, or, alternatively, a fractured microstructure (intermetallic particles exhibit are fractured in the cast structure).

At least in some of the exemplary embodiments, solute elements which are segregated during solidification towards the edge of the cell, which exist at the edge of the ingot, near the surface quenched below a transformation temperature, e.g. a solvus temperature, during initial fluid cooling, are allowed to re-distribute via solid state diffusion across the dendrite/cell and those solute elements which normally segregate to the edge of the dendrite/cell in the center region of the ingot are allowed time and temperature during solidification to backwards diffuse solute from the homogenous liquid back into the dendrite/cell prior to growth and coarsening. The result of this backwards diffusion removes solute elements from the homogenous mixture, generating a reduced concentration of solute in the homogenous mixture which in turn minimizes the volume fraction of the cast intermetallics at the unit dendrite/cell boundary, thereby reducing the overall macro-segregation effect across the ingot. Any high melting point cast constituents and intermetallics at that point are, once solidified, easily modified by the bulk diffusion of silicon (Si) or other elements present in the metal, at the elevated temperatures, yielding a denuded region at the dendrite/cell boundary equivalent to or near the concentration corresponding to the maximum solubility limit at that particular convergence temperature. Similarly, high melting point eutectics (or metastable constituents and intermetallics) may be further modified or can be further modified/transformed in structure if the convergence temperature is attained and held in a mixed phase region common to two adjoining binary phase regions. In addition to this, the nominally higher melting point cast constituents and intermetallics may be fractured and/or rounded, and low melting point cast constituents and intermetallics are more likely to melt or diffuse into the bulk material during the casting process.

Another exemplary embodiment provides a method of heating a cast metal ingot to prepare the ingot for hot-working at a predetermined hot-working temperature. The method involves (a) pre-heating the ingot to a nucleation temperature, below the predetermined hot-working temperature, at which precipitate nucleation occurs in the metal to cause nucleation to take place; (b) heating the ingot further to a precipitate growth temperature at which precipitate growth occurs to cause precipitate growth in the metal; and (c) if the ingot is not already at the predetermined hot-working temperature after step (b), heating the ingot further to said predetermined hot-working temperature ready for hot-working. The hot-working step preferably comprises hot-rolling, and the ingot is preferably cast by DC casting.

According to this method, dispersoids, commonly formed during homogenization and hot rolling, are produced in such a way that, on preheating the ingot in two stages to a hot rolling temperature and holding for a period of time, the dispersoid population size and distribution in the ingot becomes similar to or better than that which is normally found following a full homogenization process, but in a substantially shorter period of time.

Preferably, this method provides a process for thermally processing a metal ingot comprising the steps of:

(a) pre-heating an ingot to a temperature corresponding to a composition on the solvus where, (b) the portion of supersaturated material precipitating out of solution during heating contributes to the nucleation of a precipitate, (c) holding the ingot at that temperature for a period of time then, (d) increasing the temperature of the ingot to a temperature which corresponds to a composition on the solvus and, (e) allowing the portion of the supersaturated material precipitating out of solution on the second stage heating to contribute to the growth of a precipitate then, (f) holding the ingot at that temperature for a period of time to allow continued diffusion of solute from the smaller (thermally-unstable) precipitates which enhance the growth of the larger more stable precipitates or, alternatively, gradually increasing the temperature, thereby increasing the solute concentration which contributes to growth with out requiring a temperature hold.

BRIEF DESCRIPTION OF THE DRAWINGS

FIG. 24 is an XRD phase identification.

DETAILED DESCRIPTION OF THE INVENTION

The following description refers to the direct chill casting of aluminum alloys, but only as an example. The present exemplary embodiment is applicable to various methods of casting metal ingots, to the casting of most alloys, particularly light metal alloys, and especially those having a transformation temperature above 450° C. and that require homogenization after casting and prior to hot-working, e.g. rolling. In addition to alloys based on aluminum, examples of other metals that may be cast include alloys based on magnesium, copper, zinc, lead-tin and iron. The exemplary embodiment may also be applicable to the casting of pure aluminum or other metals in which the effects of one of the five results of the homogenization process may be realized (see the description of these steps above).

Figure 1:
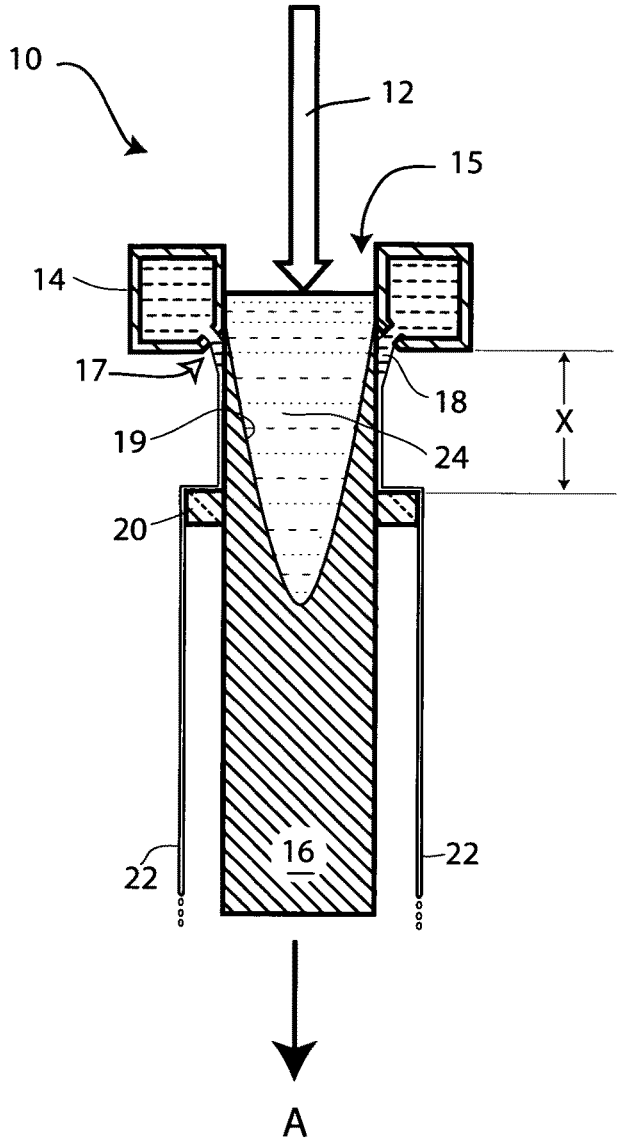
FIG. 1 is a vertical cross-section of a Direct Chill casting mold showing one preferred form of a process according to an exemplary embodiment, and particularly illustrating a case in which the ingot remains hot during the entire cast.

FIG. 1 of the accompanying drawings shows a simplified vertical cross-section of one example of a vertical DC caster 10 that may be used to carry out at least part of a process according to one exemplary form of the present exemplary embodiment. It will, of course, be realized by persons skilled in the art that such a caster could form part of a larger group of casters all operating in the same way at the same time, e.g. forming part of a multiple casting table.

Molten metal 12 is introduced into a vertically orientated water-cooled mold 14 through a mold inlet 15 and emerges as an embryonic ingot 16 from a mold outlet 17. The embryonic ingot has a liquid metal core 24 within a solid outer shell 26 that thickens as the embryonic ingot cools (as shown by line 19) until a completely solid cast ingot is produced. It will be understood that the mold 14 peripherally confines and cools the molten metal to commence the formation of the solid shell 26, and the cooling metal moves out and away from the mold in a direction of advancement indicated by arrow A? in FIG. 1. Jets 18 of coolant liquid are directed onto the outer surface of the ingot as it emerges from the mold in order to enhance the cooling and to sustain the solidification process. The coolant liquid is normally water, but possibly another liquid may be employed, e.g. ethylene glycol, for specialized alloys such as aluminum-lithium alloys. The coolant flow employed may be quite normal for DC casting, e.g. 1.04 liters per minute per centimeter of periphery to 1.78 liters per minute per centimeter of periphery (0.7 gallons per minute (gpm)/inch of periphery to 1.2 gpm/inch).

An annular wiper 20 is provided in contact with the outer surface of the ingot spaced at a distance X below the outlet 17 of the mold and this has the effect of removing coolant liquid (represented by streams 22) from the ingot surface so that the surface of the part of the ingot below the wiper is free of coolant liquid as the ingot descends further. The streams 22 of coolant are shown streaming from the wiper 20, but they are spaced at a distance from the surface of the ingot 16 so that they do not provide a cooling effect.

The distance X is made such that removal of coolant liquid from the ingot takes place while the ingot is still embryonic (i.e. it still contains the liquid center 24 contained within the solid shell 26). Put another way, the wiper 20 is positioned at a location where a cross section of the ingot taken perpendicular to the direction of advancement A intersects a portion of the liquid metal core 24 of the embryonic ingot. At positions below the upper surface of the wiper 20, continued cooling and solidification of the molten metal within the core of the ingot liberates latent heat of solidification and sensible heat to the solid shell 26. This transference of latent and sensible heat, with the lack of continued forced (liquid) cooling, causes the temperature of the solid shell 26 (below the position where the wiper 20 removes the coolant) to rise (compared to its temperature immediately above the wiper) and converge with that of the molten core at a temperature that is arranged to be above a transformation temperature at which the metal undergoes in-situ homogenization. At least for aluminum alloys, the convergence temperature is generally arranged to be at or above 425° C., and more preferably at or above 450° C. For practical reasons in terms of temperature measurement, the "convergence temperature" (the common temperature first reached by the molten core and solid shell) is taken to be the same as the "rebound temperature" which is the maximum temperature to which the solid shell rises in this process following the removal of coolant liquid.

The rebound temperature may be caused to go as high as possible above 425° C., and generally the higher the temperature the better is the desired result of in-situ homogenization, but the rebound temperature will not, of course, rise to the incipient melting point of the metal because the cooled and solidified outer shell 26 absorbs heat from the core and imposes a ceiling on the rebound temperature. It is mentioned in passing that the rebound temperature, being generally at least 425° C., will normally be above the annealing temperature of the metal (annealing temperatures for aluminum alloys are typically in the range of 343 to 415° C.).

The temperature of 425° C. is a critical temperature for most alloys because, at lower temperatures, rates of diffusion of metal elements within the solidified structure are too slow to normalize or equalize the chemical composition of the alloy across the grain. At and above this temperature, and particularly at and above 450° C., diffusion rates are suitable to produce a desired equalization to cause a desirable in-situ homogenizing effect of the metal.

In fact, it is often desirable to ensure that the convergence temperature reaches a certain minimum temperature above 425° C. For any particular alloy, there is usually a transition temperature between 425° C. and the melting point of the alloy, for example a solvus temperature or a transformation temperature, above which microstructural changes of the alloy take place, e.g. conversion from β-phase to α-phase constituent or intermetallic structures. If the convergence temperature is arranged to exceed such transformation temperatures, desired transformational changes can be introduced into the structure of the alloy.

The rebound or convergence temperature is determined by the casting parameters and, in particular, by the positioning of the wiper 20 below the mold (i.e. the dimension of distance X in FIG. 1). Distance X should preferably be chosen such that: (a) there is sufficient liquid metal remaining in the core after coolant removal, and sufficient excess temperature (super heat) and latent heat of the molten metal, to allow the temperatures of the core and shell of the ingot to reach the desired convergence temperature indicated above; (b) the metal is exposed to a temperature above 425° C. for a sufficient time after coolant removal to allow desired micro-structural changes to take place at normal rates of cooling in air at normal casting speeds; and (c) the ingot is exposed to coolant liquid (i.e. before coolant liquid removal) for a time sufficient to solidify the shell to an extent that stabilizes the ingot and prevents bleeding or break-out of molten metal from the interior.

It is usually difficult to position the wiper 20 closer than 50 mm to the mold outlet 17 while allowing sufficient space for liquid cooling and shell solidification, so this is generally the practical lower limit (minimum dimension) for the distance X. The upper limit (maximum dimension) is found as a practical matter to be about 150 mm, regardless of ingot size, in order to achieve the desired rebound temperatures, and the preferred range for distance X is normally 50 mm to 100 mm. The optimal position of the wiper may vary from alloy to alloy and from casting equipment to casting equipment (as ingots of different sizes may be cast at different casting speeds), but is always above the position at which the core of the ingot becomes completely solid. A suitable position (or range of positions) can be determined for each case by calculation (using heat-generation and heat-loss equations), or by surface temperature measurements (e.g. using standard thermocouples embedded in the surface or as surface contact or non-contact probes), or by trial and experimentation. For DC casting molds of normal capacity forming an ingot of 10 to 60 cm in diameter, casting speeds of at least 40 mm/minute, more preferably 50 to 75 mm/min (or $9.0\times10^{-4}$ to $4.0\times10^{-3}$ meters/second), are normally employed.

In some cases, it is desirable to make the distance X vary at different times during a casting procedure, i.e. by making the wiper 20 movable either closer to the mold 14 or further away from the mold. This is to accommodate the different thermal conditions encountered during the transient phases at the start and end of the casting procedure.

At the start of casting, a bottom block plugs the mold outlet and is gradually lowered to initiate the formation of the cast ingot. Heat is lost from the ingot to the bottom block (which is normally made of a heat-conductive metal) as well as from the outer surface of the emerging ingot. However, as casting proceeds and the emerging part of the ingot becomes separated from the bottom block by an increasing distance, heat is lost only from the outer surface of the ingot. At the end of casting, it may be desirable to make the outer shell cooler than normal just before casting is terminated. This is because the last part of the ingot to emerge from the mold is normally gripped by a lifting device so that the entire ingot can be raised. If the shell is cooler and thicker, the lifting device is less likely to cause deformation or tearing that may endanger the lifting operation. In order to achieve this, the rate of flow of cooling liquid may be increased at the end phase of casting.

In the start-up phase, more heat is removed from the ingot than during the normal casting phase due to the heat lost to the bottom block. In such a case, the wiper may be moved temporarily closer to the mold to reduce the length of time that the surface of the ingot is exposed to the cooling water, thus reducing heat extraction. After a certain time, the wiper may be relocated to its normal position for the normal casting phase. In the end-phase, it is found in practice that no movement of the wiper may be required but, if necessary, the wiper can be raised to compensate for the additional heat removed by the increased rate of flow of the coolant liquid.

The distance through which the wiper is moved (variation in X, i.e. ΔX) and the times at which the movements are made can be calculated from theoretical heat-loss equations, assessed from trial and experimentation, or (more preferably) based on the temperature of the ingot surface above (or possibly below) the wiper determined by an appropriate sensor. In the latter case, an abnormally low surface temperature may indicate the need for a shortening of the distance X (less cooling) and an unusually high surface temperature may indicate the need for a lengthening of the distance X (more cooling). A sensor suitable for this purpose is described in U.S. Pat. No. 6,012,507 which issued on Jan. 11, 2000 to Marc Auger et al. (the disclosure of which is incorporated herein by reference).

At the start of casting, the adjustment of the position of the wiper is usually required just for the first 50 cm to 60 cm of the casting procedure. Several small incremental changes may be made, e.g. by a distance of 25 mm in each case. For an ingot of 68.5 cm in thickness, the first adjustment may be within 150-300 mm of the start of the ingot, and then similar variations may be made at 30 cm and 50-60 cm. For a 50 cm thick ingot, the adjustments may be made at 15 cm, 30 cm, 50 cm and 80 cm. The final position of the wiper is the one required for the normal casting procedure, so the wiper starts at the closest point to the mold and is then moved down as casting proceeds. This approximates the reduction of heat-loss as the emerging part of the ingot becomes more widely separated from the bottom block as casting proceeds. The distance X thus starts out shorter than in the normal casting phase, and gradually lengthens to the distance required for normal casting.

At the end of casting, if any adjustment is required at all, it may be made within the last 25 cm of the cast, and there is normally a need for only one adjustment by one to two centimeters.

The adjustment of the wiper position of the wiper may be adjusted manually (e.g. if the wiper is supported by chains having links or eyelets through which projections (e.g. hooks) on the wiper are inserted, the wiper may be supported and raised so that the projections can be inserted through different links or eyelets). Alternatively, and more preferably, the wiper may be supported and moved by electrical, pneumatic or hydraulic jacks optionally liked by computer (or equivalent) to a temperature sensing apparatus of the type mentioned above so that the wiper may be moved according to a feedback loop with inbuilt logic. An arrangement of this type is shown in simplified form in FIG. 2.

Figure 2:
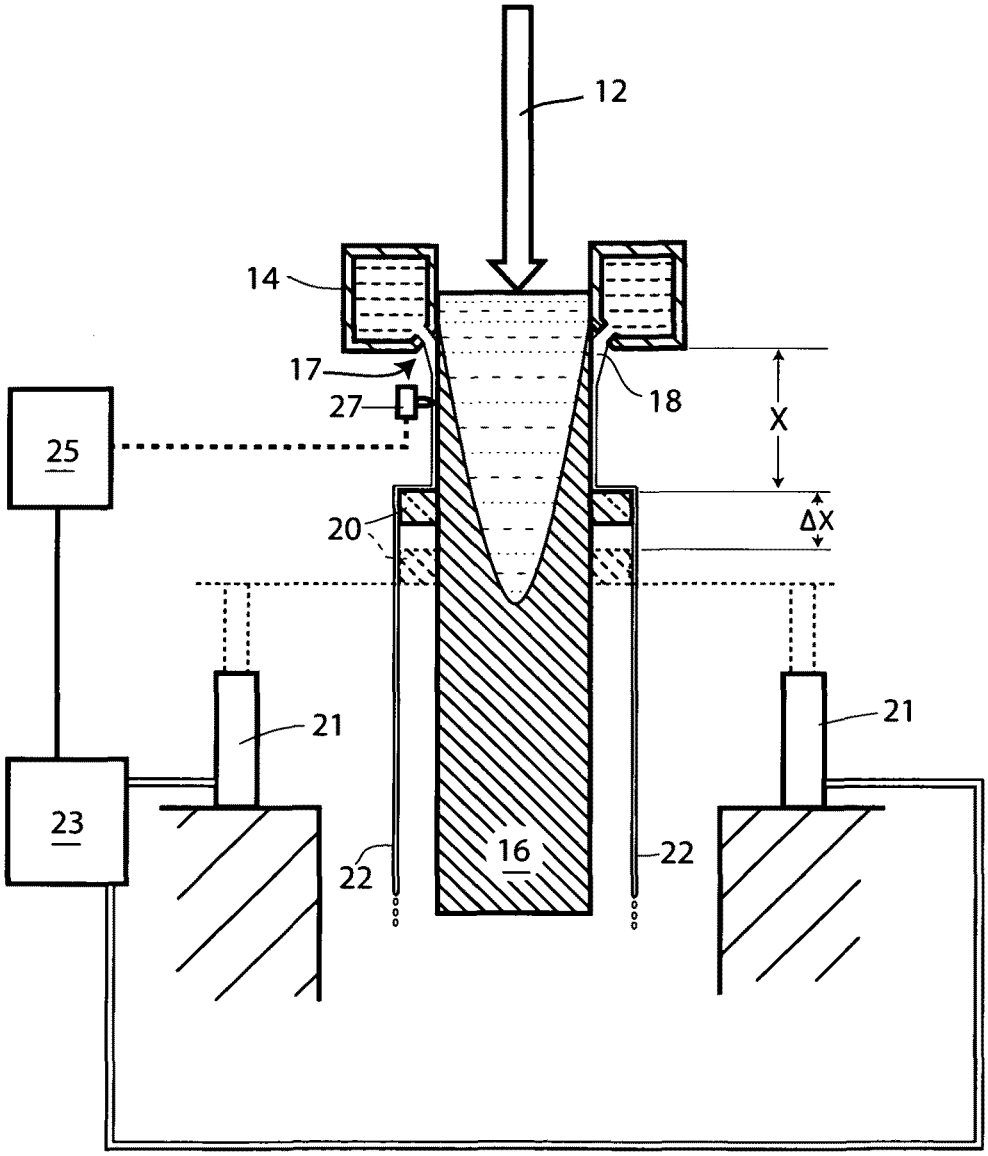
FIG. 2 is a cross-section similar to that of FIG. 1, illustrating a preferred modification in which the position of the wiper is movable during the cast.

The apparatus shown in FIG. 2 is similar to that of FIG. 1, except that the wiper 20 is adjustable in height, e.g. from an upper position shown in solid lines to a lower position shown in broken lines. Thus, the distance X from the outlet of mold 14 can be modified by ΔX (either up or down). This adjustability is possible because the wiper 20 is supported on adjustable supports 21 which are hydraulic piston and cylinder arrangements operated by a hydraulic engine 23. The hydraulic engine 23 is itself controlled by a computer 25 based on temperature information delivered by a temperature sensor 27 that monitors the surface temperature of the ingot 16 immediately below the outlet 17 of mold 14. As noted above, if the temperature recorded by sensor 27 is lower than a predetermined value, the wiper 20 may be raised, and if the temperature is above a predetermined value the wiper may be lowered.

Desirably, in all forms of the exemplary embodiments, the convergence temperature of the ingot below the wiper 20 should remain above the transformation temperature for in-situ homogenization (generally above 425° C.) for a sufficient period of time to allow desired micro-structural transformations to take place. The exact time will depend on the alloy, but is preferably in the range of 10 minutes to 4 hours depending on the elemental diffusion rates and the amount to which the rebound temperature rises above 425° C. Normally, desirable changes have taken place after no longer than 30 minutes, and often in the range of 10 to 15 minutes. This is in sharp contrast to the time required for conventional homogenization of an alloy, which is normally in the range of 46 to 48 hours at temperatures above a transformation temperature (e.g. solvus) of the metal (often 550 to 625° C.). Despite the much-reduced time of the process of the exemplary embodiments compared to conventional homogenization, the resulting microstructure of the metal is essentially the same in both cases, i.e. the cast product of the exemplary embodiments has the microstructure of a homogenized metal without having undergone conventional homogenization, and can be rolled or hot-worked without further homogenization. The present exemplary embodiment of the invention is therefore referred to as "in-situ homogenization", i.e. homogenization brought about during casting rather than afterwards.

As a result of the coolant liquid application and subsequent removal, the emerging ingot surface is first subjected to the rapid cooling characteristic of film and nucleate film boiling regimes, thereby ensuring that the surface temperature is reduced quickly to a low level (e.g. 150° C. to 300° C.), but is then subjected to coolant liquid removal, thereby allowing the excess temperature and latent-heat of the molten center of the ingot (as well as the sensible heat of the solid metal) to reheat the surface of the solid shell. This ensures that temperatures necessary for desirable micro-structural transitions are reached.

It is to be noted that, if the coolant is allowed to contact the ingot for a longer time than is desirable before being removed from the ingot surface (or if the coolant is not removed at all), it is no longer possible to make use of the substantial effect of the super- and latent-heat of solidification of the molten core to reheat the ingot shell sufficiently to achieved the desired metallurgical changes. While there would be some temperature equilibration across the ingot with such a procedure, and while this could possibly result in beneficial stress reduction and crack reduction, the desired metallurgical changes are not obtained and a conventional additional homogenization procedure would then be required before rolling the ingots to gauge or desired thickness. The same problem may occur if the coolant is removed from the ingot surface in the desired manner, and then further coolant is contacted with the ingot before temperature equilibration throughout the ingot, and desired micro-structural changes within the metal, have taken place.

In some cases, coolant (particularly water-based coolant) may be temporarily and at least partially removed from the surface of the ingot by natural nucleate film boiling, such that steam generated at the metal surface forces liquid coolant away from the ingot. Generally, however, the liquid returns to the surface as further cooling takes place. If this temporary removal of coolant takes place in advance of the wiper used in this exemplary embodiment, the ingot surface may show a double dip in its temperature profile. The coolant cools the surface until it is temporarily removed by nucleate film boiling, so that the temperature then rises to some extent, then the surface of the ingot passes through a pool of coolant held on the upper surface of the wiper (the wiper may be dished inwardly towards the ingot to promote the formation of a pool of coolant) and the temperature falls again, only to rise once again when the wiper removes all coolant from the ingot surface. This produces a characteristic "W" shape in the cooling curve of the ingot shell (as can be seen from FIGS. 23 and 24).

The wiper 20 of FIG. 1 may be in the form of an annulus of soft, temperature-resistant elastomeric material 30 (e.g. a high-temperature-resistant silicon rubber) held within an encircling rigid support housing 32 (made, for example, of metal).

While FIG. 1 illustrates a physical wiper 20, other means of coolant removal may be employed, if desired. In fact, it is often advantageous to provide non-contact methods of coolant removal. For example, jets of gas or a different liquid may be provided at the desired location to remove the coolant flowing along the ingot. Alternatively, use may be made of nucleate film boiling as indicated above, i.e. the coolant may be prevented from returning to the ingot surface after temporary removal due to nucleate film boiling. Examples of such non-contact methods of coolant removal are shown, for example, in U.S. Pat. No. 2,705,353 to Zeigler, German patent DE 1,289,957 to Moritz, U.S. Pat. No. 2,871,529 to Kilpatrick and U.S. Pat. No. 3,763,921 to Beke et al. (the disclosures of which patents are specifically incorporated herein by reference). Nucleate film boiling may be assisted by adding a dissolved or compressed gas, such as carbon dioxide or air, to the liquid coolant, e.g. as described in U.S. Pat. No. 4,474,225 to Yu, or U.S. Pat. Nos. 4,693,298 and 5,040,595 to Wagstaff (the disclosures of which are incorporated herein by reference).

Alternatively, the rate of delivery of the coolant in the streams 18 may be controlled to the point that all of the coolant evaporates from the ingot surface before the ingot reaches the critical point (Distance X) below the mold or before the surface of the ingot is cooled below a critical surface temperature. This may be done using a coolant supply as shown in U.S. Pat. No. 5,582,230 to Wagstaff et al. issued on Dec. 10, 1996 (the disclosure of which is incorporated herein by reference). In this arrangement, the coolant liquid is supplied through two rows of nozzles connected to different coolant supplies and it is a simple matter to vary the amount of coolant applied to the ingot surface to ensure that the coolant evaporates where desired (Distance X). Alternatively, or in addition, heat calculations may be made in a manner similar to those of U.S. Pat. No. 6,546,995 based on annularly successive part annular portions of the mold to ensure that a volume of water is applied that will evaporate as required.

Aluminum alloys that may be cast according to the exemplary embodiments include both non-heat-treatable alloys (e.g. AA1000, 3000, 4000 and 5000 series) and heat-treatable alloys (e.g. AA 2000, 6000 and 7000 series). In the case of heat-treatable alloys cast in the known manner, Uchida et al. taught in PCT/JP02/02900 that a homogenization step followed by a quench to a temperature below 300° C., preferably to room temperature, prior to heating and hot rolling, and subsequent solution heat treatment and aging, exhibits superior properties (dent resistance, improved blank formed values and hard properties) when compared to conventionally processed materials. Unexpectedly, this characteristic can be duplicated in the exemplary embodiments during the ingot casting procedure, if desired, by subjecting the ingot (i.e. the part of the ingot that has just undergone in-situ homogenization) to a quench step after a sufficient period of time has passed (e.g. at least 10 to 15 minutes) following coolant liquid removal to allow homogenization of the alloy, but prior to substantial additional cooling of the ingot.

Figure 3:
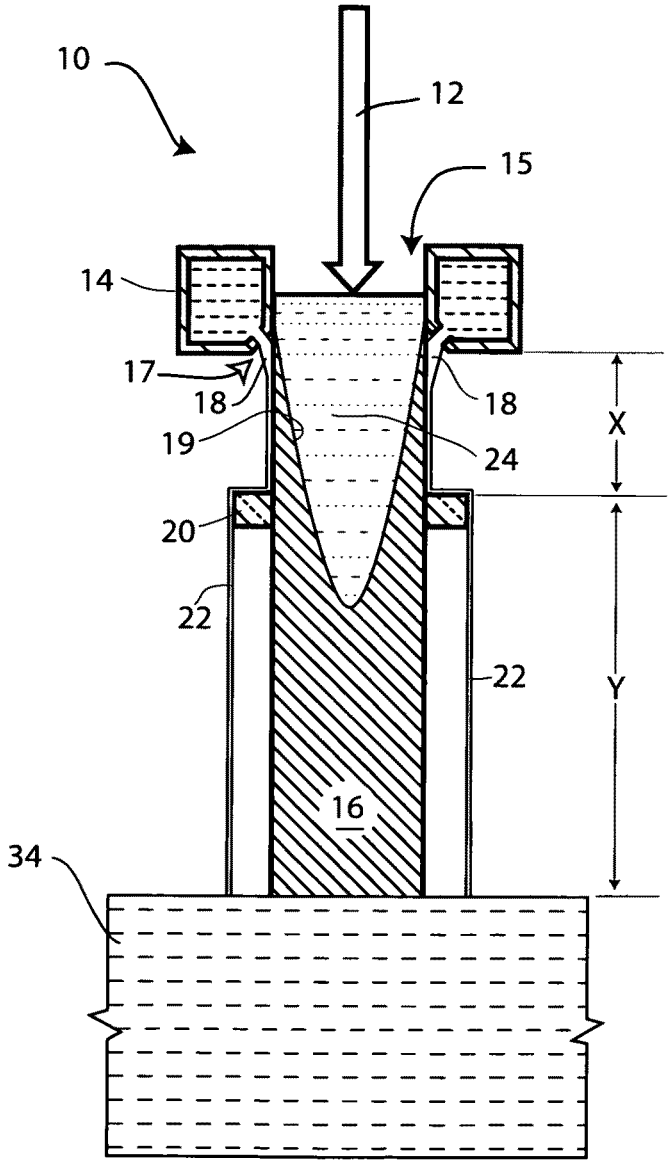
FIG. 3 is a cross-section similar to that of FIG. 1, illustrating a case in which the ingot is additionally cooled (quenched) at the lower end during the cast.

This final quench (in-situ quench) is illustrated in FIG. 3 of the accompanying drawings where a DC casting operation (essentially the same as that of FIG. 1) is carried out, but the ingot is immersed in a pool 34 of water (referred to as a pit pool or pit water) at a suitable distance Y beneath the point at which the coolant is removed from the ingot. The distance Y must, as stated, be sufficient to allow the desired in-situ homogenization to proceed for an effective period of time, but insufficient to allow substantial further cooling. For example, the temperature of the outer surface of the ingot just prior to immersion in the pool 34 should preferably be above 425° C., and desirably in the range of 450 to 500° C. The immersion then causes a rapid water quench of the temperature of the ingot to a temperature (e.g. 350° C.) below which transformations of the solid structure do not take place at an appreciable rate. After this, the ingot may be cut to form a standard length used for rolling or further processing.

Incidentally, to enable an ingot to be water quenched over its entire length, the casting pit (the pit into which the ingot descends as it emerges from the mold) should be deeper than the length of the ingot, so that when no further molten metal is added to the mold, the ingot can continue to descend into the pit, and into the pool 34 until it is fully submerged. Alternatively, the ingot may be partially submerged to a maximum depth of the pool 34, and then more water may be introduced into the casting pit to raise the level of the surface of the pool until the ingot is fully submerged.

Figure 9:
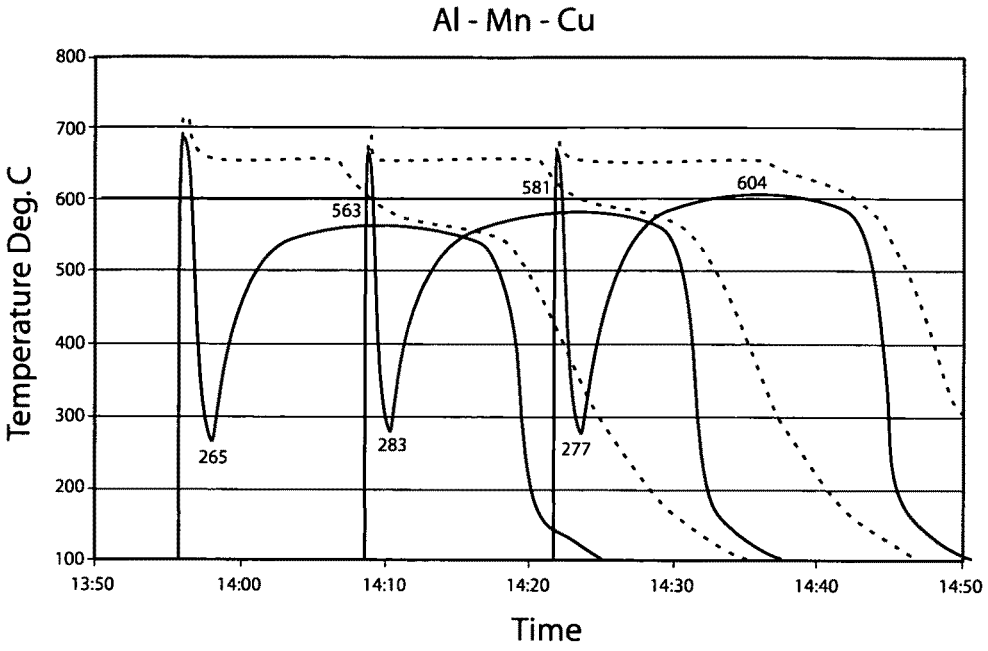
FIG. 9 is a graph similar to FIG. 7 but showing temperature measurements of the same cast carried out at three slightly different times (different ingot lengths as shown in the figure). The solid lines show the surface temperatures of the three plots, and the dotted lines show the core temperatures. The times for which the surface temperatures remain above 400° C. and 500° C. can be determined from each plot and are greater than 15 minutes in each case. The rebound temperatures of 563, 581 and 604° C. are shown for each case.

It should be noted that the exemplary embodiments are not limited to the casting of cylindrical ingots and it can be applied to ingots of other shapes, e.g. rectangular ingots or those formed by a shaped DC casting mold as disclosed in FIG. 9 or FIG. 10 of U.S. Pat. No. 6,546,995, issued on Apr. 15, 2003 to Wagstaff (the disclosure of this patent is incorporated herein by reference). FIG. 10 of the patent is duplicated in the present application as FIG. 4, which is a top plan view looking into the casting mold. It will be seen that the mold is approximately "J"-shaped and it is intended to produce an ingot having a corresponding cross-sectional shape. An embryonic ingot produced from such a mold would have a molten core that is spaced from the outer surface by different distances at points around the circumference of the ingot, and thus, given equal cooling termination around the ingot circumference (distance X), different amounts of super- and latent-heat of solidification would be delivered to different parts of the ingot shell.

It is, in fact, desirable to subject all parts of the shell around the periphery to the same convergence temperature. In U.S. Pat. No. 6,546,995, equal casting characteristics around the mold are assured by adjusting the geometry of the casting surfaces of the mold to suit the shape of the cast ingot. In the exemplary embodiments, it is possible to ensure that each part of the embryonic ingot shell (after termination of cooling) is subjected to the same heat input from the molten core and the same convergence temperature by dividing the ingot circumference into notional segments according to the shape of the ingot, and removing coolant fluid at different distances from the mold outlet in different segments. Some segments (the ones that will be subjected to higher heat inputs from the core) will be exposed to the cooling fluid for a longer period of time than other segments (those that will have less heat exposure). Some segments of the shell will therefore have a lower temperature than others after the cooling fluid is removed, and this lower temperature will compensate for the higher heat input to those segments from the core so that convergence temperatures equalize around the circumference of the ingot.

Such a procedure may be achieved, for example, by designing a wiper (a) shaped to fit snugly around the shaped ingot, and (b) having different planes or a shaped contour at the end of the wiper facing the mold, the different planes or sections of the contour having different spacing from the outlet of the mold. FIG. 5 is a plot showing variations in distance X around the periphery of the mold of FIG. 4 designed to produce even convergence temperatures around the ingot (the plot begins at point S in FIG. 4 and proceeds in a clockwise direction). A wiper having a corresponding peripheral shape is then used to cause the desired equalization of convergence temperature around the periphery of the ingot.

Figure 4:
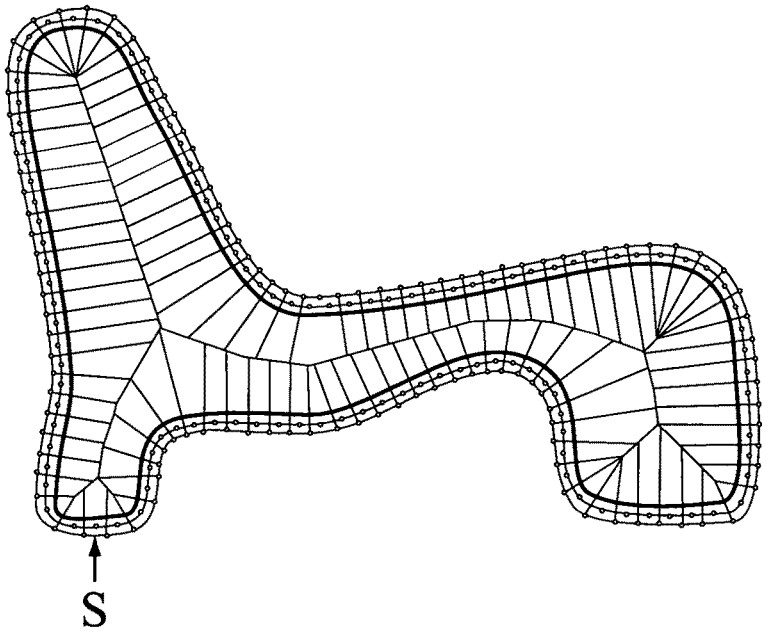
FIG. 4 is a top plan view of a J-shaped casting mold illustrating a preferred form of an exemplary embodiment.
Figure 5:
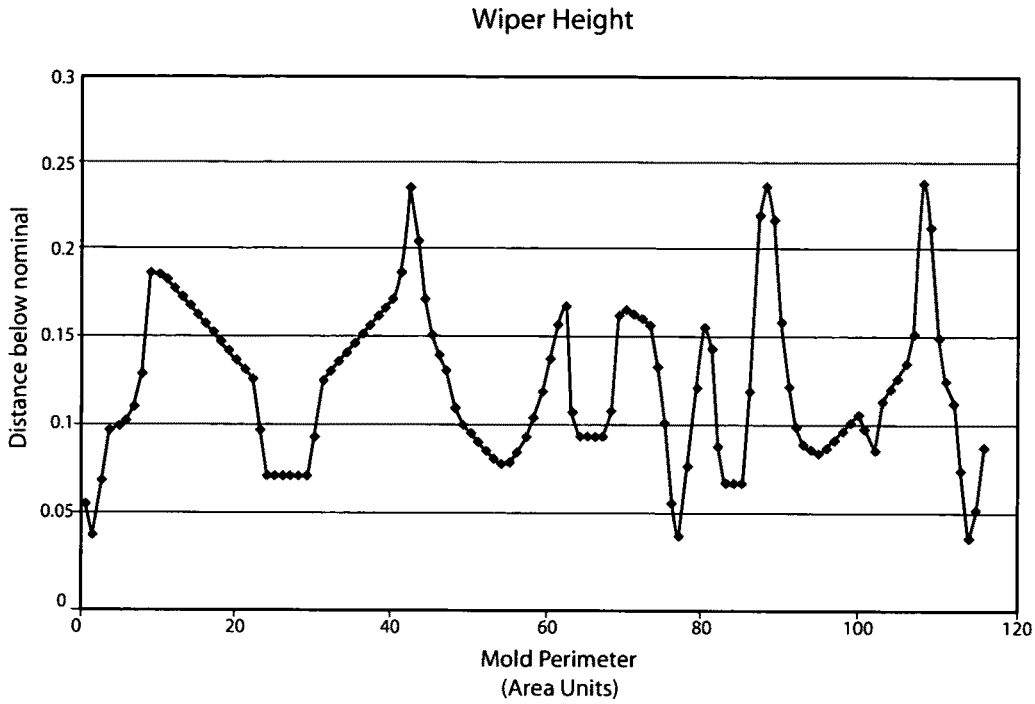
FIG. 5 is a graph showing distances X of FIG. 1 for a mold of the type shown in FIG. 4, the values of X corresponding to points around the periphery of the mold measured in a clockwise direction from point S in FIG. 4.
Figure 6:
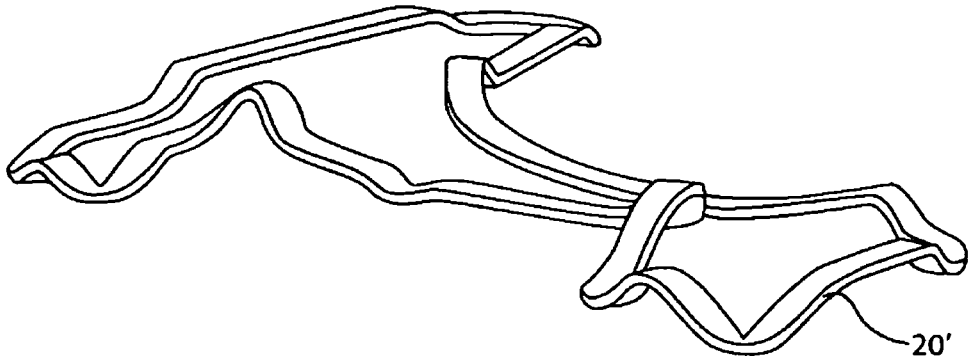
FIG. 6 is a perspective view of a wiper designed for the casting mold of FIG. 4.

FIG. 6 illustrates a wiper 20' that could be effective for casting an ingot having a shape similar to that of FIG. 4. It will be seen that the wiper 20' has a complex shape with parts that are elevated with respect to other parts, thereby ensuring that the cooling liquid is removed from the outer surface of the emerging ingot at positions designed to equalize the convergence temperature around the ingot at positions below the wiper 20'.

The points at which the coolant is removed from the various segments, and the width of the segments themselves, can be decided by computer modeling of the heat flux within the cast ingot, or by simple trial and experimentation for each ingot of different shape. Again, the goal is to achieve the same or very similar convergence temperatures around the periphery of the ingot shell.

As already discussed at length, the exemplary embodiments, at least in its preferred forms, provides an ingot having a microcrystalline structure resembling or identical to that of the same metal cast in a conventional way (no wiping of coolant liquid) and later subjected to conventional homogenization. Therefore, the ingots of the exemplary embodiments can be rolled or hot-worked without resorting to a further homogenization treatment. Normally, the ingots are first hot-rolled and this requires that they be pre-heated to a suitable temperature, e.g. normally at least 500° C., and more preferably at least 520° C. After hot-rolling, the resulting sheets of intermediate gauge are then normally cold-rolled to final gauge.

As a further aspect of the exemplary embodiments, it has been found that at least some metals and alloys benefit from a particular optional two-stage pre-heating procedure after ingot formation and prior to hot-rolling. Such ingots may ideally be produced by the "in-situ homogenization" process described above, but may alternatively be produced by conventional casting procedures, in which case advantageous improvements are still obtained. This two-stage pre-heating procedure is particularly suitable for alloys intended to have "deep-draw" characteristics, e.g. aluminum alloys containing Mn and Cu (e.g. AA3003 aluminum alloy having 1.5 wt. % Mn and 0.6 wt. % Cu). These alloys rely on precipitation or dispersion strengthening. In the two-stage pre-heating procedure, DC cast ingots are normally scalped and then set in a preheat furnace for a two-stage heating process involving: (1) heating slowly to an intermediate nucleating temperature below a conventional hot-rolling temperature for the alloy concerned, and (2) continuing to heat the ingot slowly to a normal hot-rolling pre-heat temperature, or a lower temperature, and holding the alloy at that temperature for a number of hours. The intermediate temperature allows for nucleation of the metal and for the re-absorption or destruction of unstable nuclei and their replacement with stable nuclei that form centers for more robust precipitate growth. The period of holding at the higher temperature allows time for precipitate growth from the stable nuclei before rolling commences.

Stage (1) of the heating process may involve holding the temperature at the nucleating temperature (the lowest temperature at which nucleation commences) or, more desirably, involves gradually raising the temperature towards the higher temperature of stage (2). The temperature during this stage may be from 380-450° C., more preferably 400-420° C., and the temperature may be held or slowly raised within this range. The rate of temperature increase should preferably be below 25° C./hr, and more preferably below 20° C./hr, and generally extends over a period of 2 to 4 hours. The rate of heating to the nucleating temperature may be higher, e.g. an average of about 50° C./hour (although the rate in the first half hour or so may be faster, e.g. 100-120° C./hr, and then slows as the nucleating temperature is approached).

After stage (1), the temperature of the ingot is raised further (if necessary) either to the hot-rolling temperature or to a lower temperature at which precipitate growth may take place, usually in the range of 480-550° C., or more preferably 500-520° C. The temperature is then held constant or slowly raised further (e.g. to the hot-rolling temperature) for a period of time that is preferably not less than 10 hours and not more than 24 hours in total for the entire two-stage heating process.

While heating the ingot directly to the rolling pre-heat temperature (e.g. 520° C.) makes the secondary crystal or precipitate population high, the resulting precipitates are generally small in size. The preheat at the intermediate temperature leads to nucleation and then the continued heating to or below the rolling pre-heat temperature (e.g. 520° C.) leads to growth in size of the secondary precipitates, e.g. as more Mn and Cu comes out of solution and the precipitates continue to grow.

After heating to the hot-rolling temperature, conventional hot-rolling is normally carried out without delay.

The process herein described involving in-situ homogenization can also be used to cast composite ingots as described in U.S. patent application Ser. No. 10/875,978 filed Jun. 23, 2004, and published on Jan. 20, 2005 as U.S. 2005-0011630, and also as described in U.S. Pat. No. 6,705,384 issued on Mar. 16, 2004, the complete disclosures of which are incorporated herein by this reference.

The invention is described in more detail in the following Examples and Comparative Examples, which are provided for illustrative purposes only and should not be considered limiting.

Example 1

Three direct chill cast ingots were cast in a 530 mm and 1,500 mm Direct Chill Rolling Slab Ingot Mold with a final length of greater than 3 meters. The ingots had an identical composition of Al 1.5% Mn; 6% Cu according to U.S. Pat. No. 6,019,939 (the disclosure of which is incorporated herein by reference). A first ingot was DC cast according to a conventional procedure, a second was DC cast with in-situ homogenization according to the procedure shown in FIGS. 7 and 8, where the coolant is removed and the ingot is allowed to cool to room temperature after being removed from the casting pit, and the third was DC cast with in-situ quench homogenization according to the procedure of FIG. 9, where the coolant is removed from the surface of the ingot and the ingot is allowed to reheat then quench in a pit of water approximately one meter below the mold.

Figure 7:
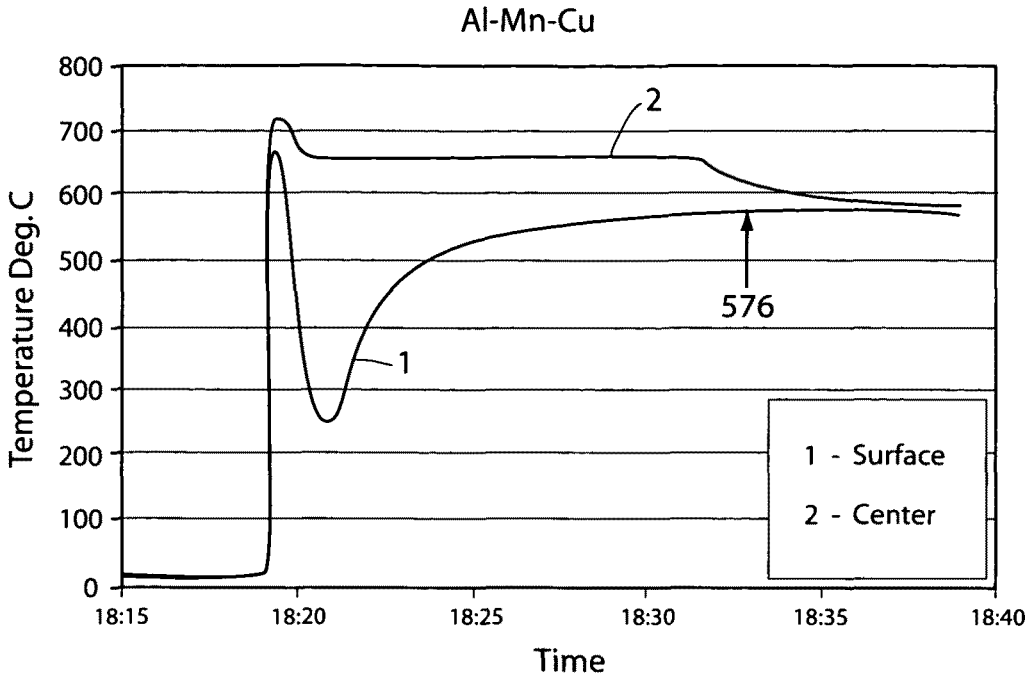
FIG. 7 is a graph illustrating a casting procedure according to one form of an exemplary embodiment, showing the surface temperature and core temperature over time of an Al-1.5% Mn-0.6% Cu alloy as it is DC cast and then subjected to water cooling and coolant wiping. The thermal history in the region where solidification and reheat takes place of an Al-1.5% Mn-0.6% Cu alloy similar to that of U.S. Pat. No. 6,019,939 in the case where the bulk of the ingot is not forcibly cooled (the lower temperature trace is the surface, and the upper (dashed) trace is the center).

In more detail, FIG. 7 shows the surface temperature and the center (core) temperature over time of an Al—Mn—Cu alloy as it is DC cast and then subjected to water cooling and coolant wiping. The plot of the surface temperature shows a deep dip in temperature immediately after casting as the ingot comes into contact with the coolant, but the temperature in the center remains little changed. The surface temperature dips to a low of about 255° C. just prior to coolant removal. The surface temperature then ascends and converges with the central temperature at a convergence or rebound temperature of 576° C. After the convergence (when the ingot is fully solid) the temperature falls slowly and is consistent with air cooling.

Figure 8:
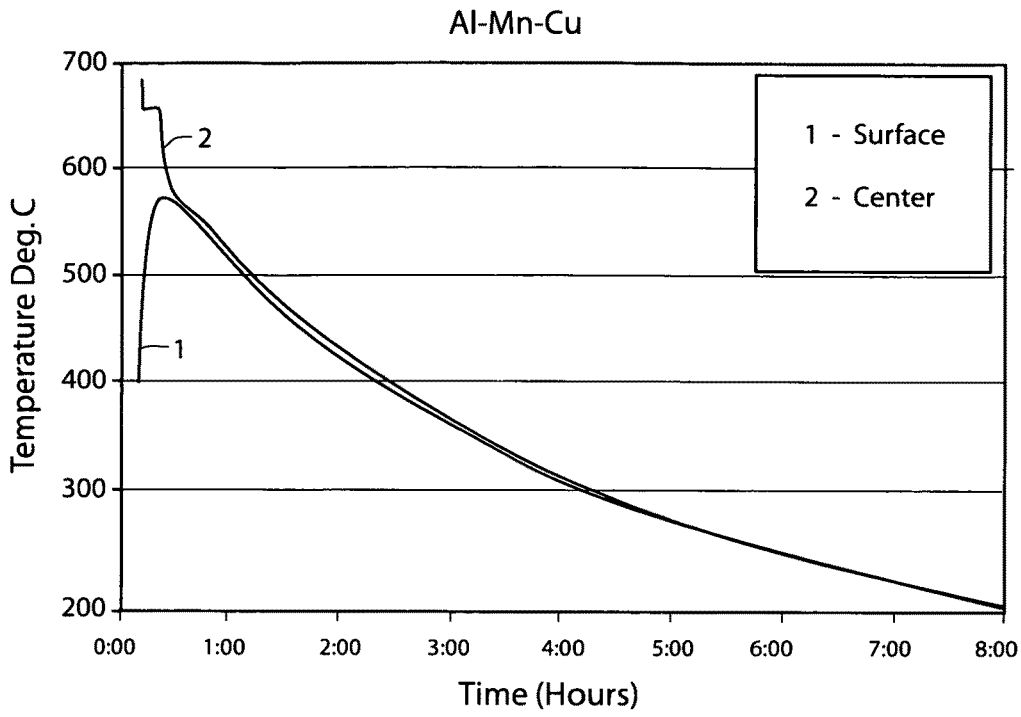
FIG. 8 is a graph illustrating the same casting operation as FIG. 7 but extending over a longer period of time and showing in particular the cooling period following temperature convergence or rebound.

FIG. 8 shows the same casting operation as FIG. 7, but extending over a longer period of time and showing in particular the cooling period following temperature convergence or rebound. It can be seen from this that the temperature of the solidified ingot remains above 425° C. for more than 1.5 hours, which is ample to achieve the desired in-situ homogenization of the ingot.

FIG. 9 is similar to FIG. 7 but showing temperature measurements of the same cast carried out at three slightly different times (different ingot lengths as shown in the figure). The solid lines show the surface temperatures of the three plots, and the dotted lines show the temperatures at the center of the thickness of the ingot. The times for which the surface temperatures remain above 400° C. and 500° C. can be determined from each plot and are greater than 15 minutes in each case. The rebound temperatures of 563, 581 and 604° C. are shown for each case.

Samples of these ingots were then rolled either with a conventional pre-heat to a hot-rolling temperature, or with various pre-heats to demonstrate the nature of the exemplary embodiments.

The casting procedures were carried out under industry-typical cooling conditions e.g., 60 mm/min, 1.5 liters/min/cm, 705° C. metal temperature.

Each ingot was sectioned along the center (mid-section) yielding two portions of each ingot of width 250 mm, then, while maintaining the thermal history at the center and at the surface, each 250 mm slab was sectioned into multiple rolling ingots, 75 mm thick, 250 mm wide (in the original ingot % thickness) and 150 mm long (in the cast direction).

The rolling ingots were then treated in the following ways.

Sample A (Direct Chill cast with conventional thermal history and modified conventional homogenization) was placed in a 615° C. furnace, where approximately after two and one half (2.5) hours the metal temperature stabilized and was held for an additional 8 hours at 615° C. The sample received a furnace quench over three hours to 480° C. and was then soaked at 480° C. for 15 hours, then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 10A:
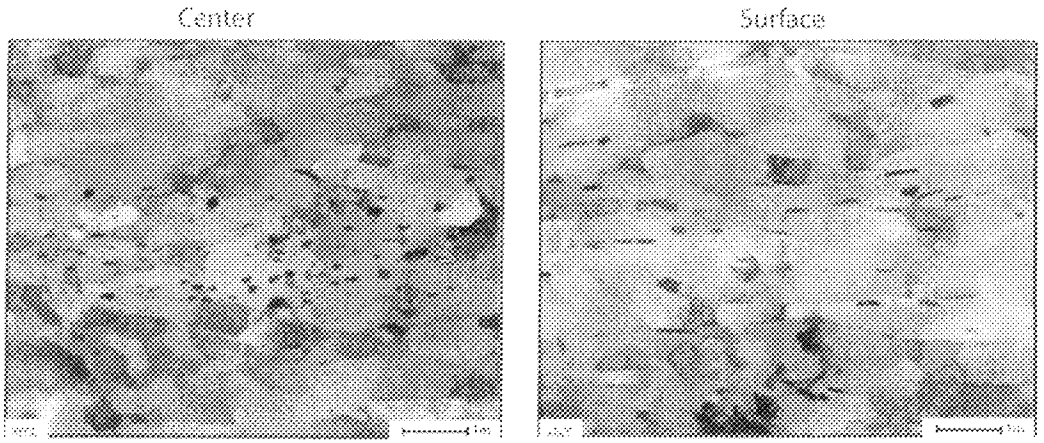
FIG. 10*a* shows transmission electron micrographs of Al-1.5% Mn-0.6% Cu alloy similar to that of U.S. Pat. No. 6,019,939 with a solidification and cooling history according to the commercial Direct Chill Process, and thermal and mechanical processing history according to Sample A in the following Example, showing the typical precipitate population at 6 mm thickness, found 25 mm from the surface and the center of the ingot.
Figure 10B:
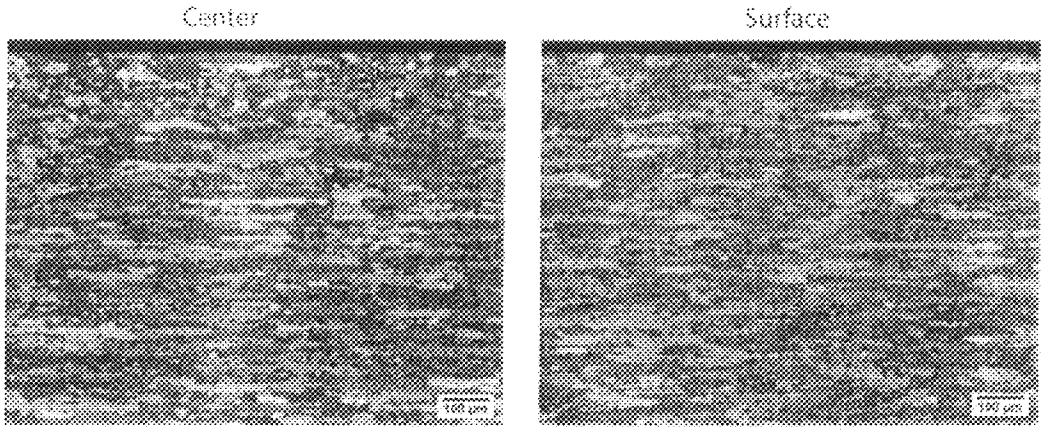
FIG. 10*b* is a photomicrograph of the same area in the sheet of FIG. 10*a*, but shown in polarized light to reveal the recrystallized cell size.

Transmission electron micrographs showing the secondary precipitate distribution, were characterized in longitudinal sections taken within one inch from either edge (surface and center) of the 6 mm material (FIG. 10*a*). Recrystallized grain structures were characterized in longitudinal sections taken within one inch from either edge (surfaces and center) of the 1 mm thick material (FIG. 10*b*).

This sample represents conventional casting and homogenization, except that the homogenization step was abbreviated to a total of 26 hours, whereas normal conventional homogenization is carried on for 48 hours.

Sample B (Direct Chill cast with a conventional cast thermal history and with modified two-stage pre-heat) was placed in a 440° C. furnace, where approximately after two (2) hours the metal temperature stabilized and was held for an additional 2 hours at 440° C. Furnace temperatures were raised to allow the metal to heat to 520° C. over two (2) hours and the sample was held for 20 hours then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 11A:
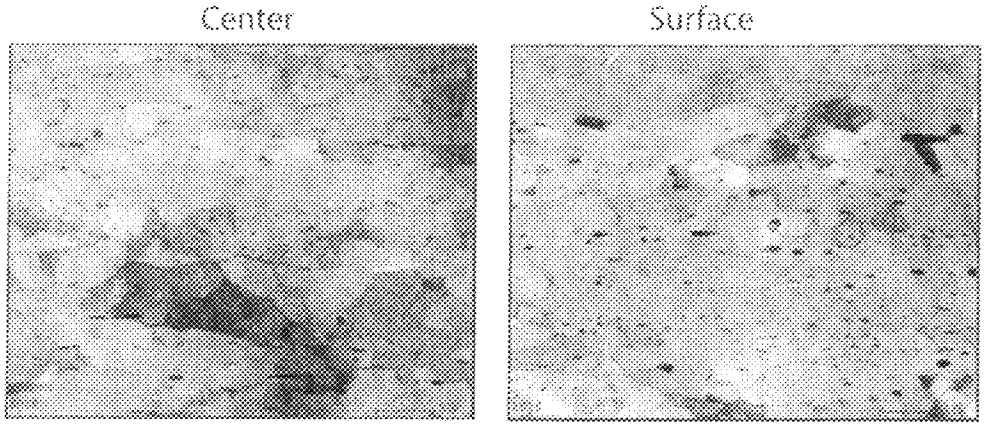
FIG. 11*a* shows transmission electron micrographs of Al-1.5% Mn-0.6% Cu, alloy similar to that of U.S. Pat. No. 6,019,939 with a solidification and cooling history according to the commercial Direct Chill Process, and thermal and mechanical processing history according to Sample B of the following Example, showing the typical precipitate population at 6 mm thickness, found 25 mm from the surface and the center of the ingot.
Figure 11B:
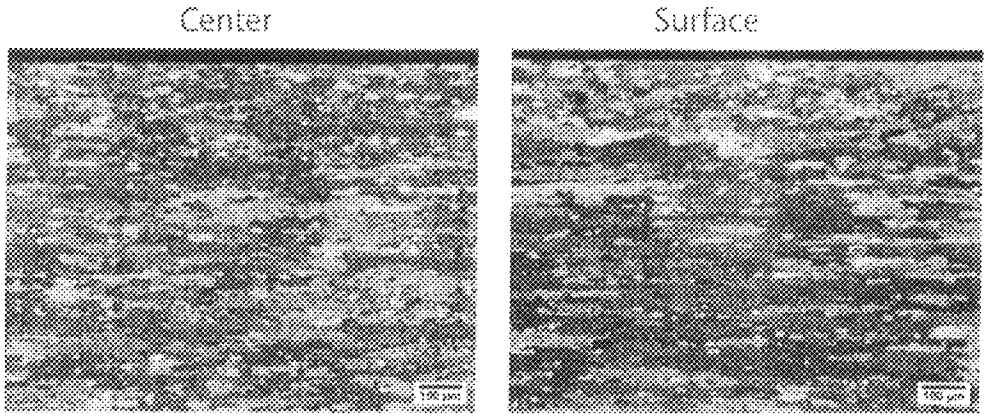
FIG. 11*b* is a photomicrograph of the same area in the sheet as FIG. 11*a* but shown in polarized light to reveal the recrystallized cell size.

Transmission electron micrographs showing the secondary precipitate distribution, were characterized in longitudinal sections taken within one inch from either edge (surface and center) of the 6 mm thick material (FIG. 11*a*). Recrystallized grain structures were characterized in longitudinal sections taken within one inch from either edge (surfaces and center) of the 1 mm thick material (FIG. 11*b*).

Sample C (Direct Chill cast with in-situ homogenization (according to FIGS. 7 and 8) cast thermal history and with modified two-stage pre-heat) was placed in a 440° C. furnace, where approximately after two (2) hours the metal temperature stabilized and was held for an additional 2 hours at 440° C. Furnace temperatures were raised to allow the metal to heat to 520° C. over two (2) hours and the sample was held for 20 hours then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 12A:
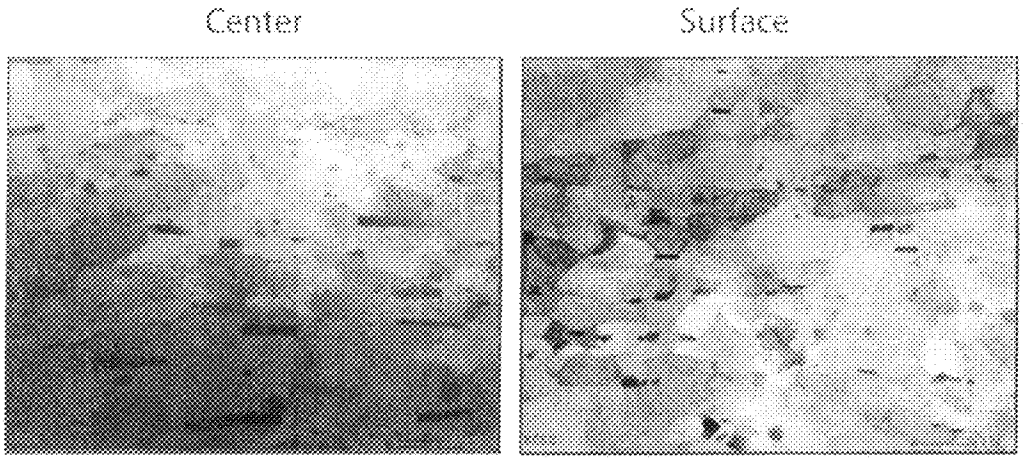
FIG. 12*a* shows transmission electron micrographs of Al-1.5% Mn-0.6% Cu, alloy similar to that of U.S. Pat. No. 6,019,939 with a solidification and cooling history according to FIG. 7 and FIG. 8, and thermal and mechanical processing history according to Sample C in the following Example, showing the typical precipitate population at 6 mm thickness, found 25 mm from the surface and the center of the ingot.
Figure 12B:
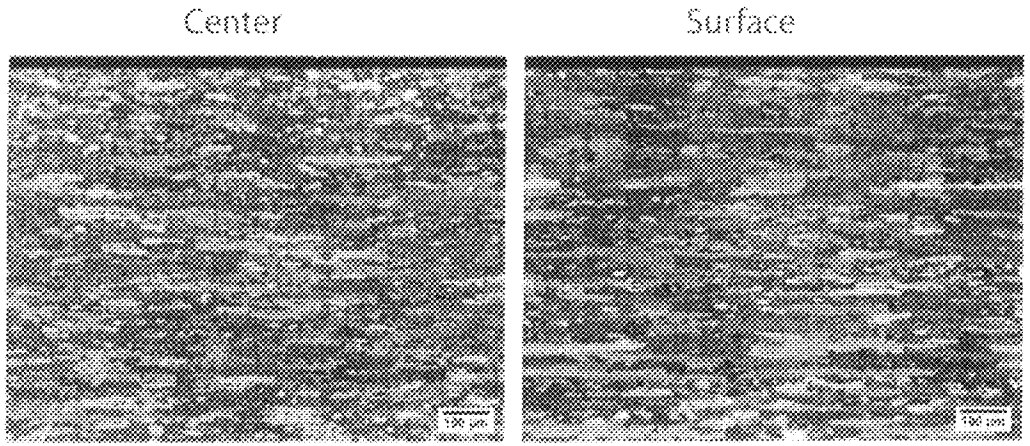
FIG. 12*b* is a photomicrograph of the same area in the sheet as FIG. 12*a* but shown in optical polarized light to reveal the recrystallized cell size.

Transmission electron micrographs showing the secondary precipitate distribution, were characterized in longitudinal sections taken within one inch from either edge (surface and center) of the 6 m thick material (FIG. 12*a*). Recrystallized grain structures were characterized in longitudinal sections taken within one inch from either edge (surfaces and center) of the 1 mm thick material (FIG. 12*b*).

Sample D (Direct Chill casting with in-situ homogenization and quick quench (FIG. 9) with a two-stage pre heat) was placed in a 440° C. furnace, where after two (2) hours the metal temperature stabilized and held for an additional 2 hours at 440° C. Furnace temperatures were raised to allow the metal to heat to 520° C. over two (2) hours and held for 20 hours then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 13A:
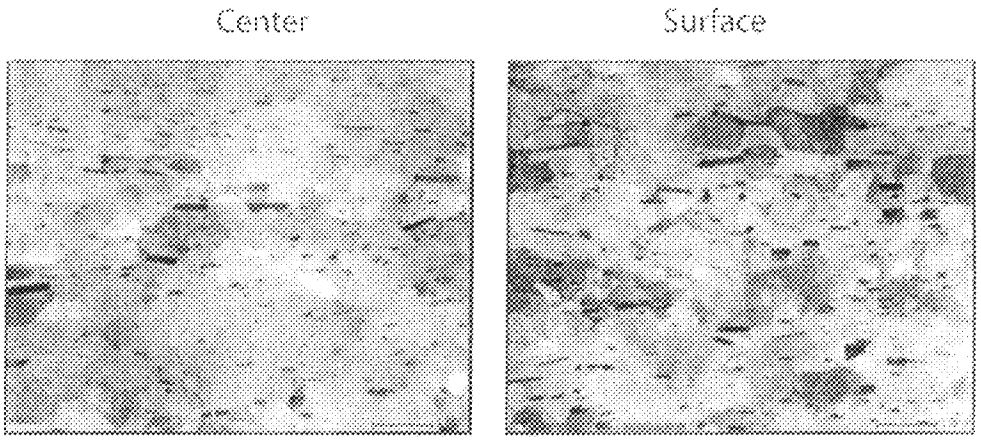
FIG. 13*a* shows transmission electron micrographs of Al-1.5% Mn-0.6% Cu, alloy similar to that of U.S. Pat. No. 6,019,939 with solidification and cooling history according to FIG. 9, and a thermal and mechanical processing history according to Sample D of the following Example, showing the typical precipitate population at 6 mm thickness, found 25 mm from the surface and the center of the ingot.
Figure 13B:
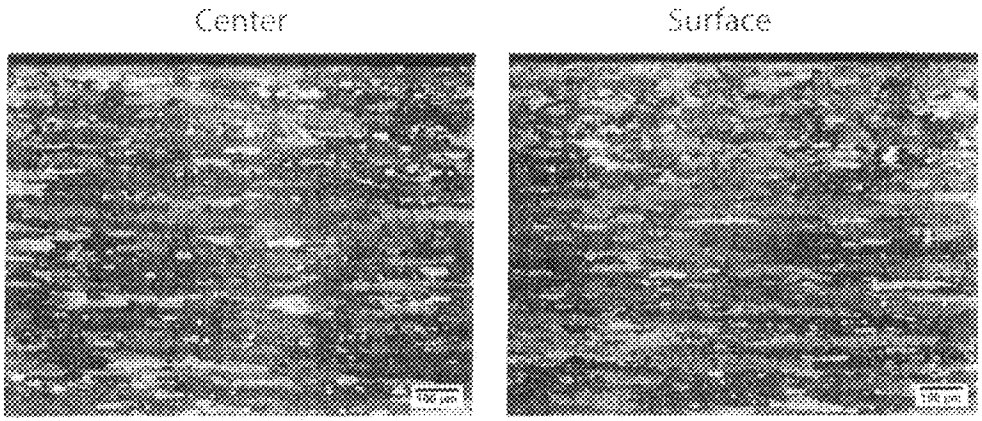
FIG. 13*b* is a photomicrograph of the same area in the sheet as FIG. 13*a* but shown in polarized light to reveal the recrystallized cell size.

Transmission electron micrographs showing the secondary precipitate distribution, were characterized in longitudinal sections taken within 25 mm from either edge (surface and center) of the 6 mm thick material (FIG. 13*a*). Recrystallized grain structures were characterized in longitudinal sections taken within 25 mm from either edge (surfaces and center) of the 1 mm thick material (FIG. 13*b*).

Sample F (Direct Chill cast with conventional thermal history and modified conventional homogenization) was placed in a 615° C. furnace, where approximately after two and one half (2.5) hours the metal temperature stabilized and was held for an additional 8 hours at 615° C. The sample received a furnace quench over three hours to 480° C. and was then soaked at 480° C. for 38 hours, then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 14A:
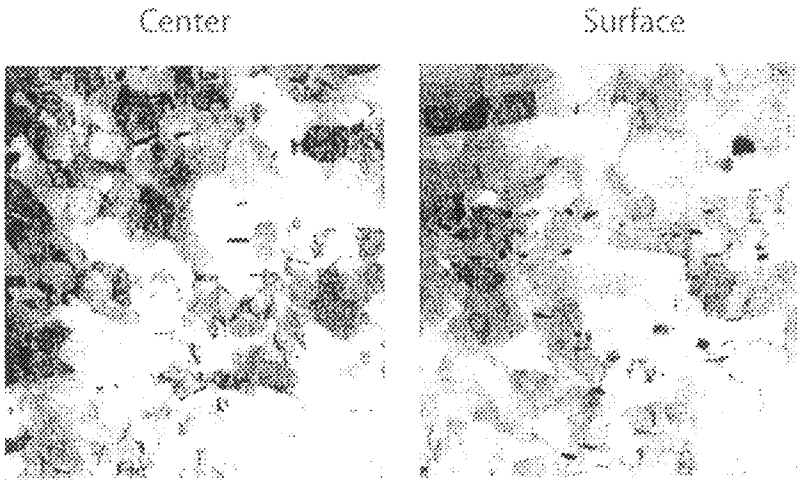
FIG. 14*a* shows transmission electron micrographs of Al-1.5% Mn-0.6% Cu alloy similar to that of U.S. Pat. No. 6,019,939 with a solidification and cooling history according to the commercial Direct Chill Process, and thermal and mechanical processing history according to Sample E in the following Example, showing the typical precipitate population at 6 mm thickness, found 25 mm from the surface and the center of the ingot.
Figure 14B:
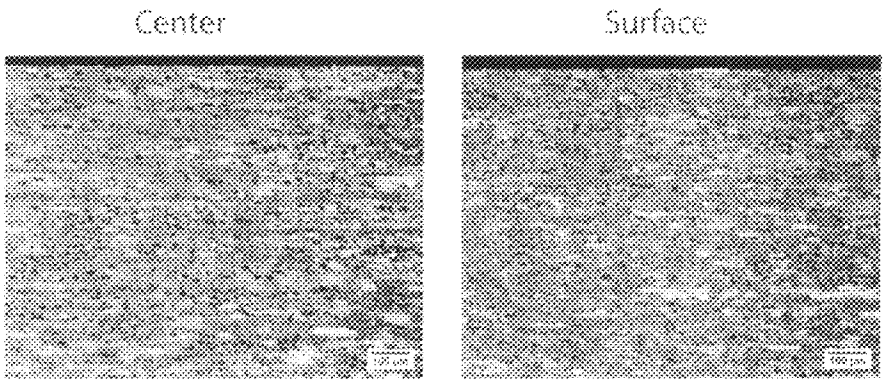
FIG. 14*b* is a photomicrograph of the same area in the sheet of FIG. 14*a*, but shown in polarized light to reveal the recrystallized cell size.

Transmission electron micrographs showing the secondary precipitate distribution, were characterized in longitudinal sections taken within one inch from either edge (surface and center) of the 6 mm material (FIG. 14*a*). Recrystallized grain structures were characterized in longitudinal sections taken within 25 mm from either edge (surfaces and center) of the 1 mm thick material (FIG. 14*b*). This sample represents conventional casting and homogenization, whereas normal conventional homogenization is carried on for 48 hours.

Sample G (Direct Chill cast with a modified single-stage pre-heat) was placed in a 520° C. furnace, where approximately after two (2) hours the metal temperature stabilized and was held for 20 hours at 520° C., then removed and hot rolled to 6 mm in thickness. A portion of this 6 mm gauge was then cold rolled to 1 mm thickness, heated to an annealing temperature of 400° C. at a rate of 50° C./hr, and held for two hours, and then furnace cooled.

Figure 15A:
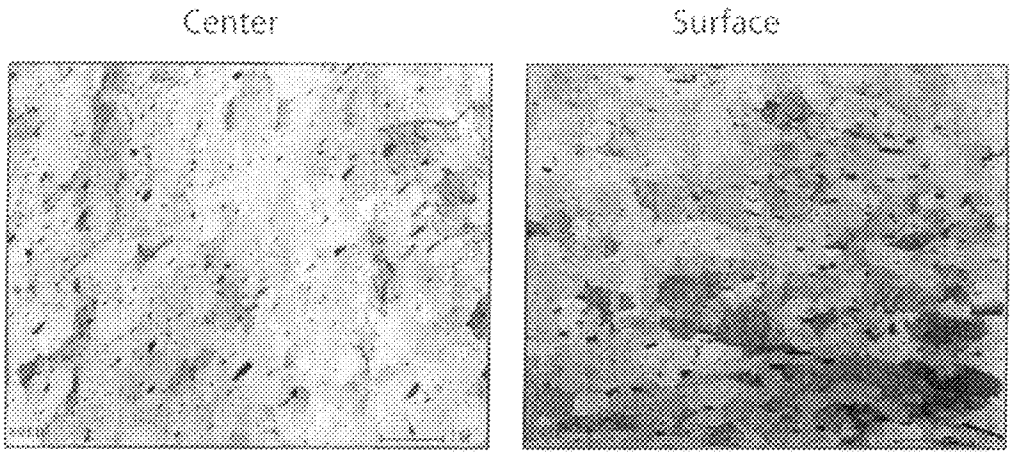
FIG. 15*a* shows transmission electron micrographs of Al-1.5% Mn-0.6% Cu alloy similar to that of U.S. Pat. No. 6,019,939 with a solidification and cooling history according to the commercial Direct Chill Process, and thermal and mechanical processing history according to Sample F in the following Example, showing the typical precipitate population at 6 mm thickness, found 25 mm from the surface and the center of the ingot.
Figure 15B:
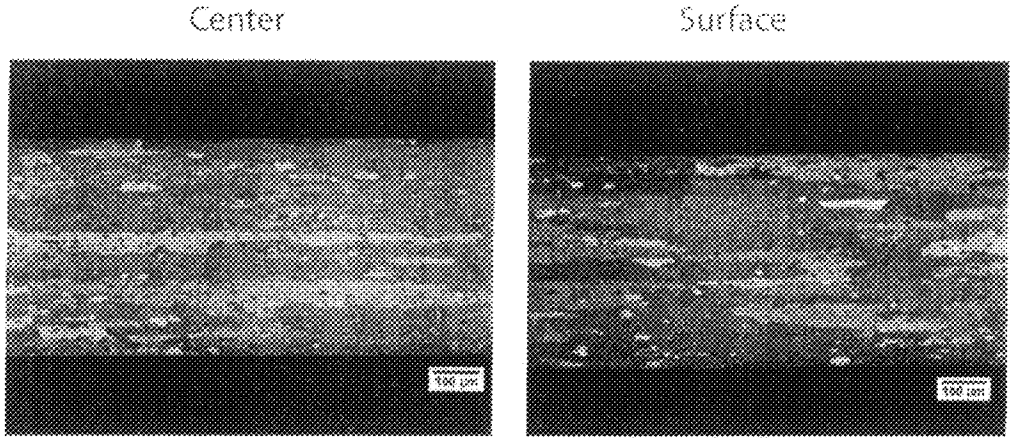
FIG. 15*b* is a photomicrograph of the same area in the sheet of FIG. 15*a*, but shown in polarized light to reveal the recrystallized cell size.

Transmission electron micrographs showing the secondary precipitate distribution, were characterized in longitudinal sections taken within one inch from either edge (surface and center) of the 6 mm thick material (FIG. 15*a*). Recrystallized grain structures were characterized in longitudinal sections taken within 25 mm from either edge (surfaces and center) of the 1 mm thick material (FIG. 15*b*).

Comparative Example 1

Figure 16:
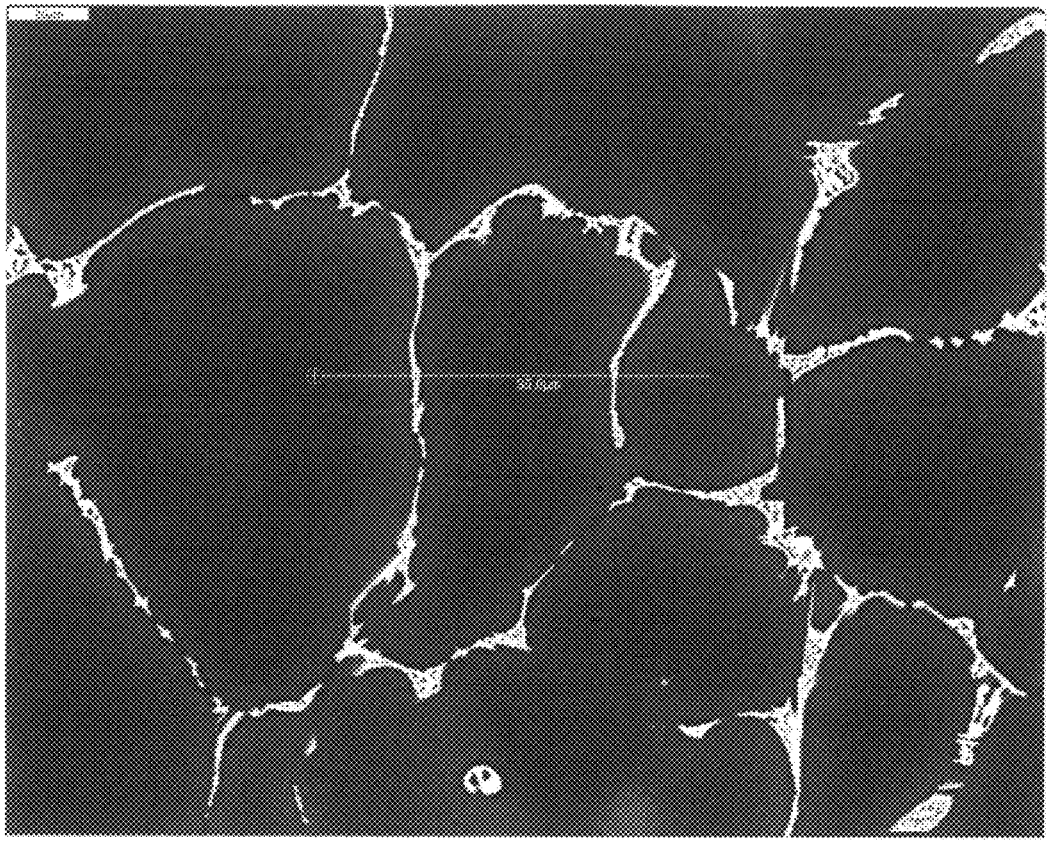
FIG. 16 is a scanning electron micrograph with Copper (Cu) Line Scan of Al-4.5% Cu through the center of a solidified grain structure showing the typical microsegregation common to the Conventional Direct Chill Casting process.
Figure 16:
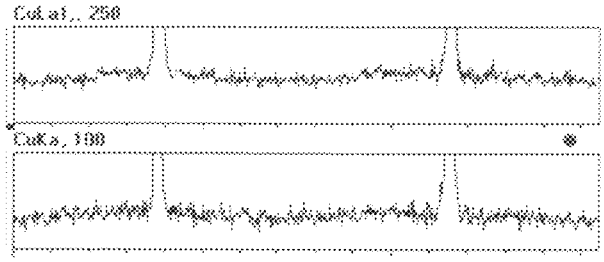
Figure 17:
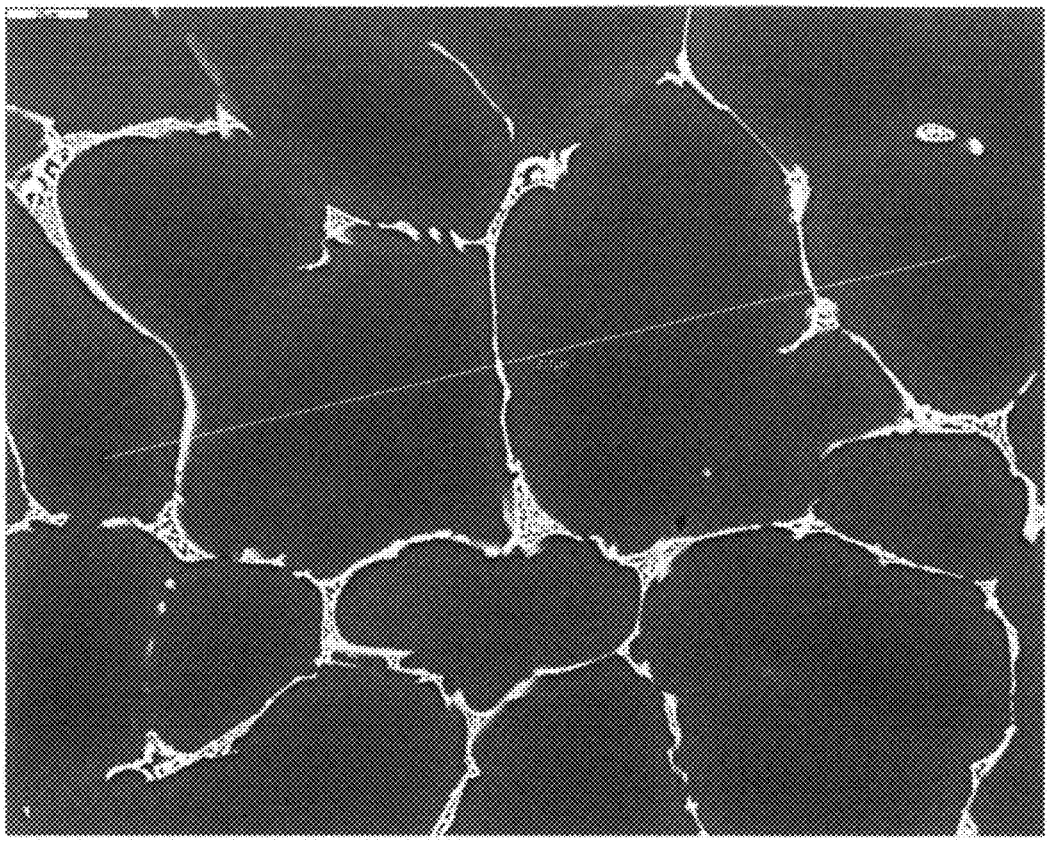
FIG. 17 is an SEM Image with Copper (Cu) Line Scan of Al-4.5% Cu with a wiper and a rebound/convergence temperature (300° C.) in the range taught by Ziegler, U.S. Pat. No. 2,705,353 or Zinniger, U.S. Pat. No. 4,237,961.
Figure 17:
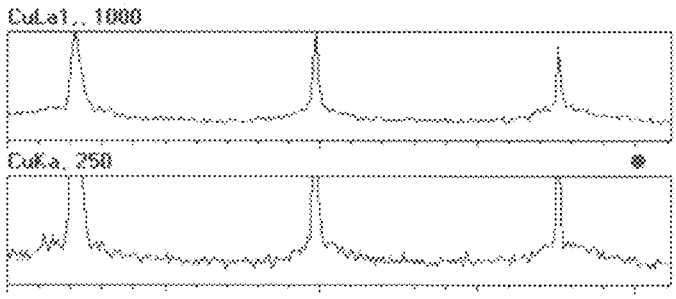
Figure 18:
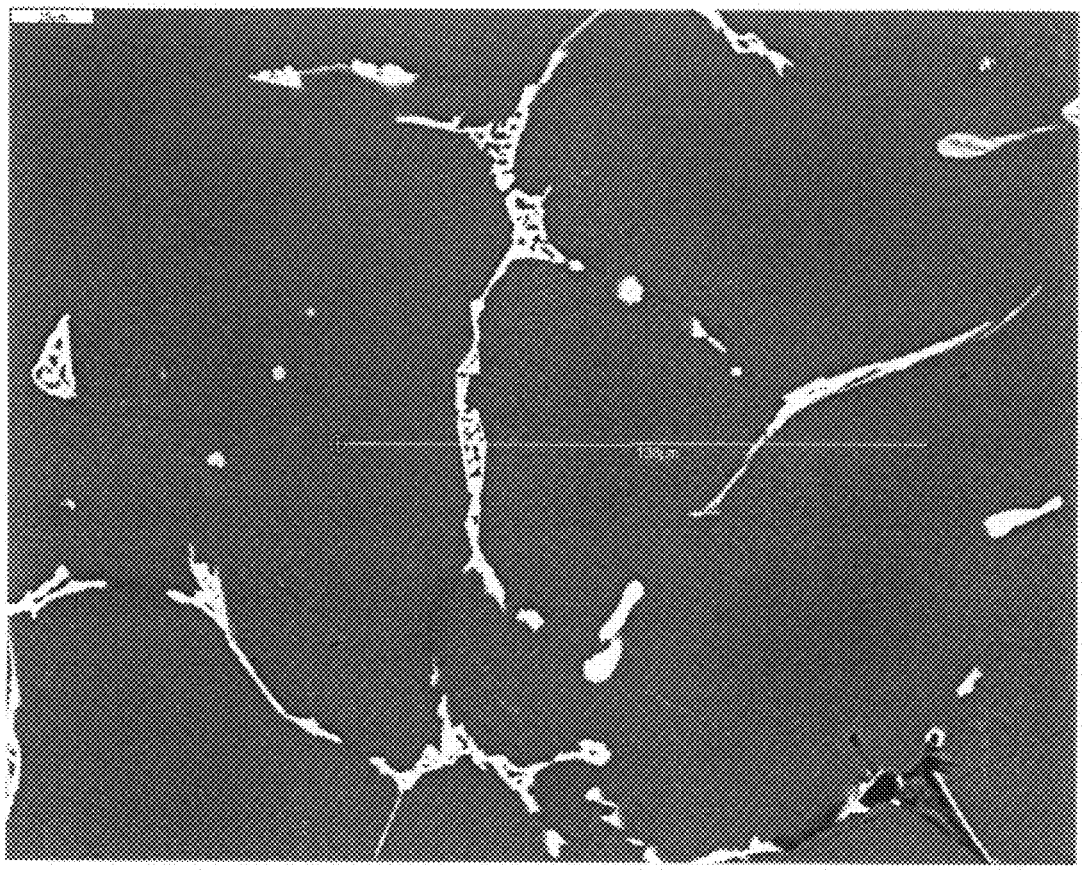
FIG. 18 is an SEM Image with Copper (Cu) Line Scan of Al-4.5% Cu according to an exemplary embodiment in the case where the bulk of the ingot is not forcibly cooled (See FIG. 19).
Figure 18:
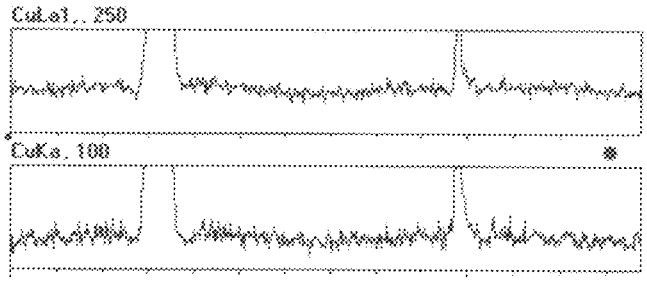
Figure 19:
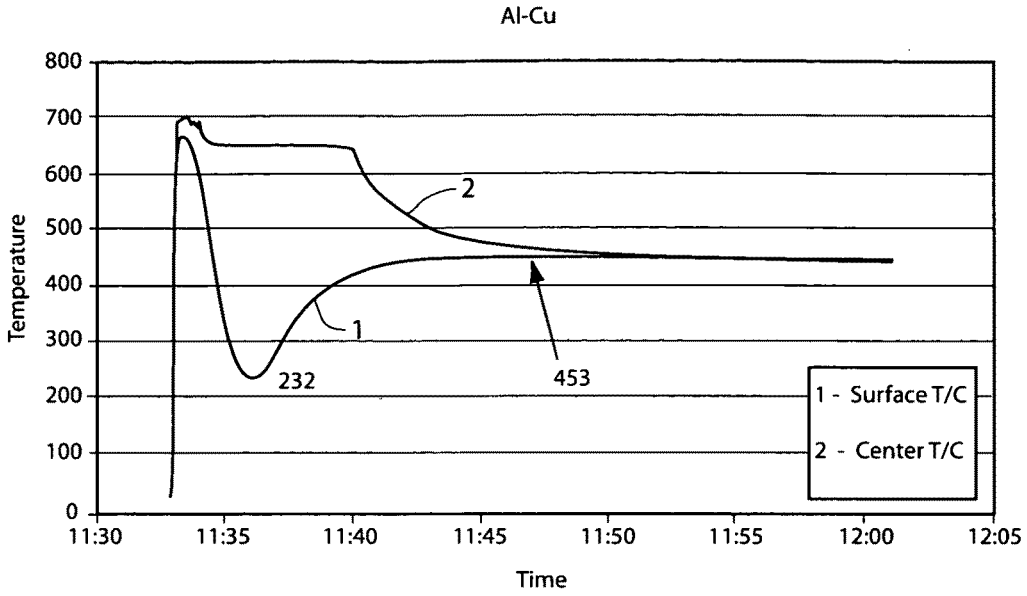
FIG. 19 is a graph illustrating the thermal history of an Al-4.5% Cu alloy in the region where solidification and reheat takes place in the case where the bulk of the ingot is not forcibly cooled (See FIG. 18).

In order to illustrate the difference of the exemplary embodiments from known casting procedures, ingots of an Al-4.5 wt % Cu alloy were cast according to conventional DC casting, according to the procedure of U.S. Pat. No. 2,705,353 to Ziegler or U.S. Pat. No. 4,237,961 to Zinniger, and according to the exemplary embodiments. The Ziegler/Zinniger casting employed a wiper positioned to generate a rebound/convergence temperature of only 300° C. The casting process of the exemplary embodiments employed a wiper positioned to generate a rebound temperature of 453° C. Scanning electron micrographs of the three resulting products were produced and are shown in FIGS. 16, 17 and 18, respectively. FIG. 19 shows the core and surface temperatures of the casting procedure carried out according to the exemplary embodiments without a quench (see FIG. 18).

The SEMs show how the concentration of copper varies across the cell in the product of the casting procedures carried out not in accordance with the exemplary embodiments (FIGS. 16 and 17—note the upward curve of the plots between the peaks). In the case of the product of the exemplary embodiments, however, the SEM shows much less variation of Cu content within the cell (FIG. 18). This is typical of a microstructure of a metal that has undergone conventional homogenization.

Example 2

Figure 20:
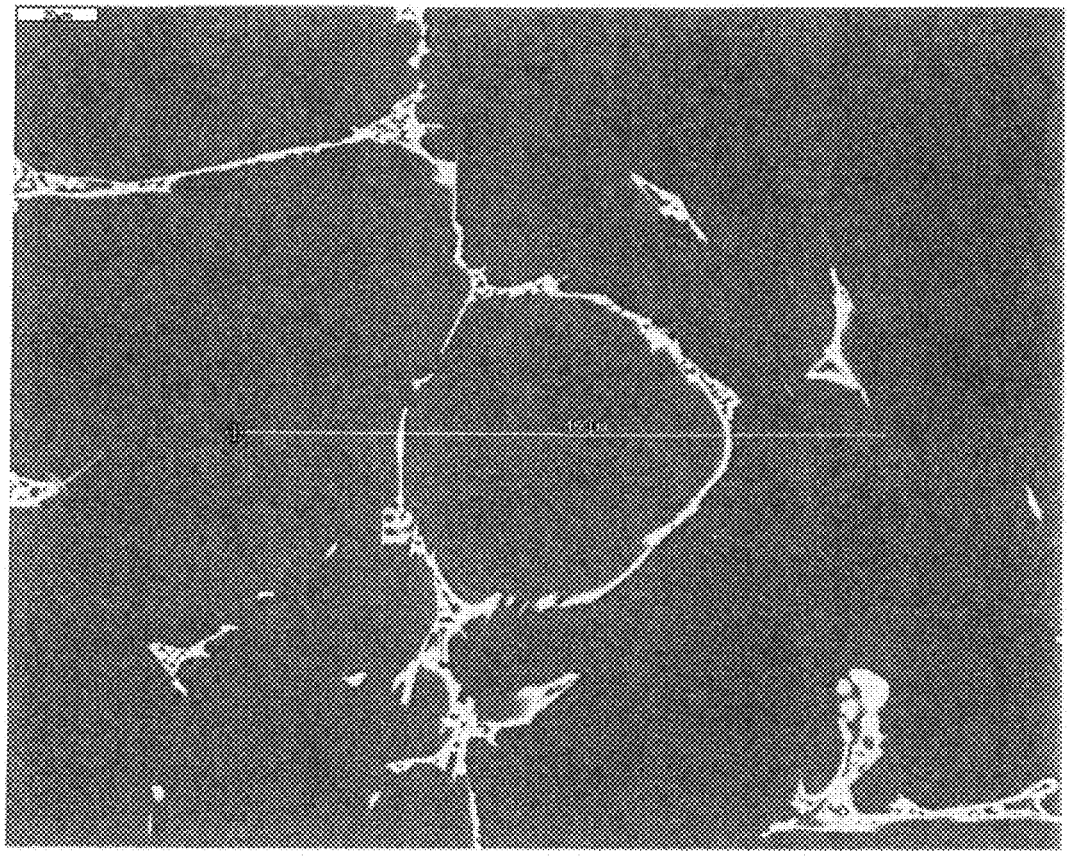
FIG. 20 is an SEM Image with Copper (Cu) Line Scan of Al-4.5% Cu according to an exemplary embodiment in the case where the bulk of the ingot is forcibly cooled after an intentional delay (See FIG. 21).
Figure 20:
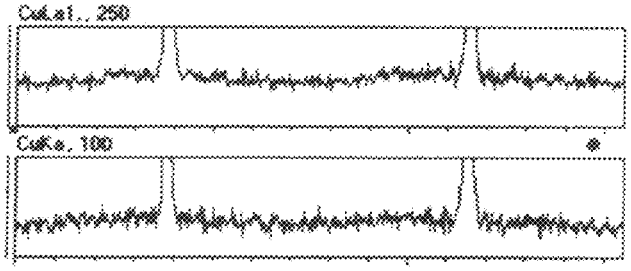

An Al-4.5% Cu ingot was cast according to the invention and the ingot was cooled (quenched) at the end of the cast. FIG. 20 is and SEM with Copper (Cu) Line Scan of the resulting ingot. The absence of any coring of Copper in the unit cell is to be noted. Although the cells are slightly larger than those of FIG. 16, there is a reduced amount of cast intermetallic at the intersection of the unit cells and the particles are rounded.

Figure 21:
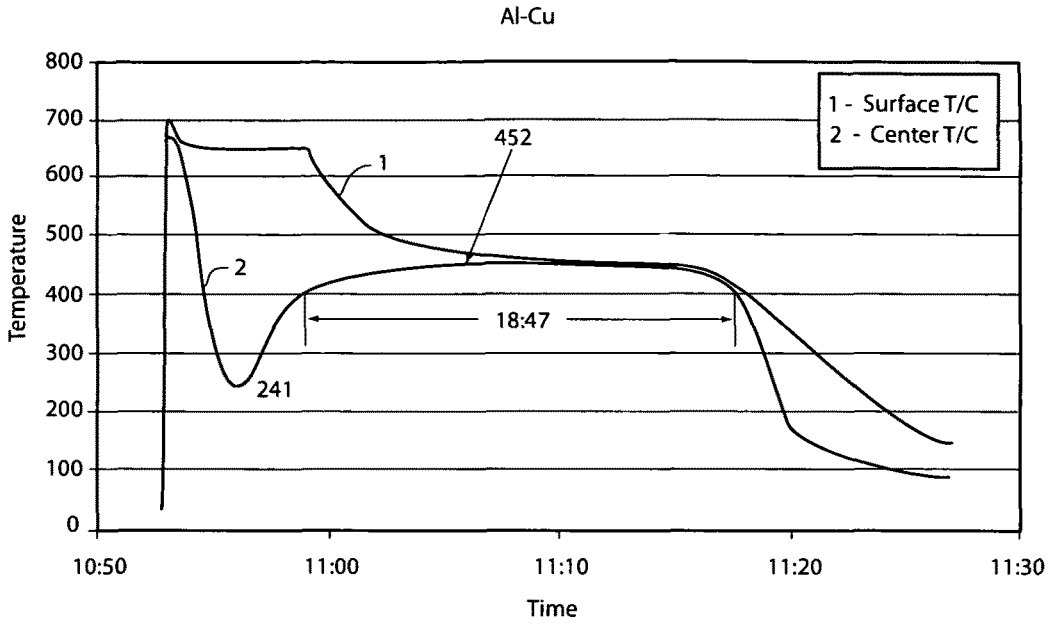
FIG. 21 is a graph showing the thermal history in the region where solidification and reheat takes place of an Al-4.5% Cu alloy in the case where the bulk of the ingot is forcibly cooled after an intentional delay (See FIG. 20).

FIG. 21 shows the thermal history of the casting of the ingot illustrating the final quench at the end of the cast. The convergence temperature (452° C.) in this case is below the solvus for the composition chosen, but desirable properties are obtained.

Comparative Example 2

Figure 22:
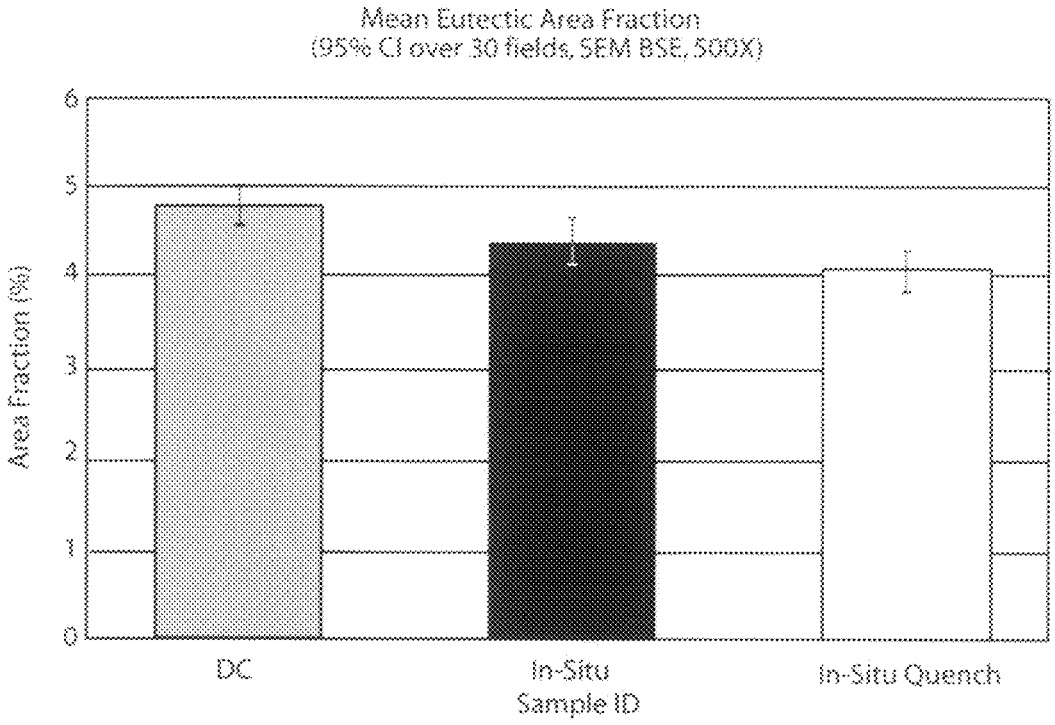
FIG. 22 is a graph showing representative area fractions of cast intermetallic phases compared across three various processing routes.

FIG. 22 shows representative area fractions of cast intermetallic phases comparing the three various processing routes as indicated above (conventional DC casting and cooling (labeled DC), DC casting and cooling without final quench according to the exemplary embodiments (labeled In-Situ Sample ID), and DC casting with final quench according to the exemplary embodiments (labeled In-Situ Quench). A smaller area is considered better for mechanical properties of the resulting alloy. This comparison shows a decreasing cast intermetallic phase area fraction according to the different methods in the given order. The highest phase area is produced by the conventional DC route and the lowest by the invention with final quench.

Example 3

Figure 23:
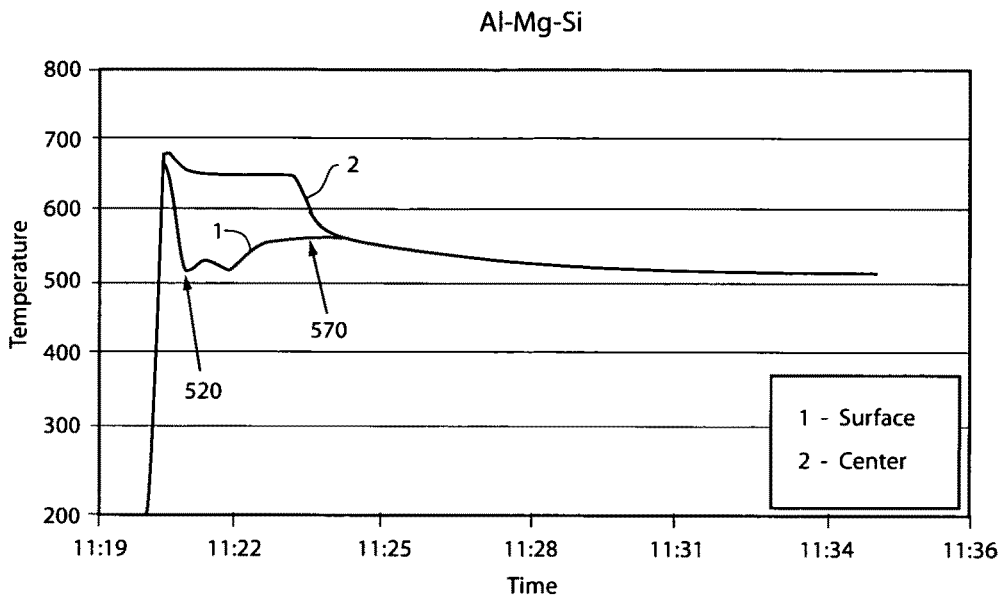
FIG. 23 is a graph illustrating the thermal history in the region where solidification and reheat takes place of an Al-0.5% Mg-0.45% Si alloy (6063) in the case where the bulk of the ingot is not forcibly cooled.

An ingot of an Al-0.5% Mg-0.45% Si alloy (6063) was cast according to a process as illustrated in the graph of FIG. 23. This shows the thermal history in the region where solidification and reheat takes place in a case where the bulk of the ingot is not forcibly cooled.

Figure 24:
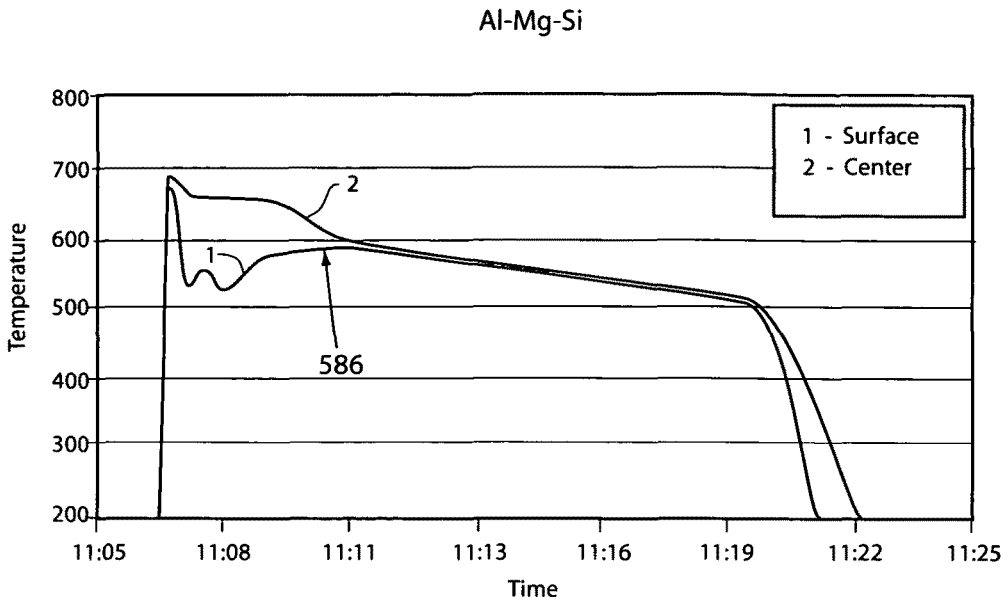
FIG. 24 is a graph illustrating the thermal history in the region where solidification and reheat takes place of an Al-0.5 Mg-0.45% Si alloy (AA6063) in the case where the bulk of the ingot is forcibly cooled after an intentional delay.

The same alloy was cast under the conditions shown in FIG. 24 (including a quench). This shows the temperature evolution of an ingot where the surface and core temperatures converged at a temperature of 570° C., and which is then forcibly cooled to room temperature. This can be compared to the procedure shown in FIG. 8 which involved a high rebound temperature and slow cooling, which is desirable when a more rapid correction of the cellular segregation is needed, or when the alloy contains elements that diffuse at a slow pace. The use of a high rebound temperature (considerably above the solvus of the alloy), held for a prolonged period of time, allows elements near the grain boundary to diffuse quite quickly into the cast intermetallic phases, thereby allowing modification or a more complete transformation to more useful or beneficial intermetallic phases, and the formation of a precipitate free zone around the cast intermetallic phases. It will be noted that FIG. 24 shows the "W" shape of the cooling curve for the shell characteristic of nucleate film boiling in advance of the wiper.

Comparative Example 3

Figure 25A:
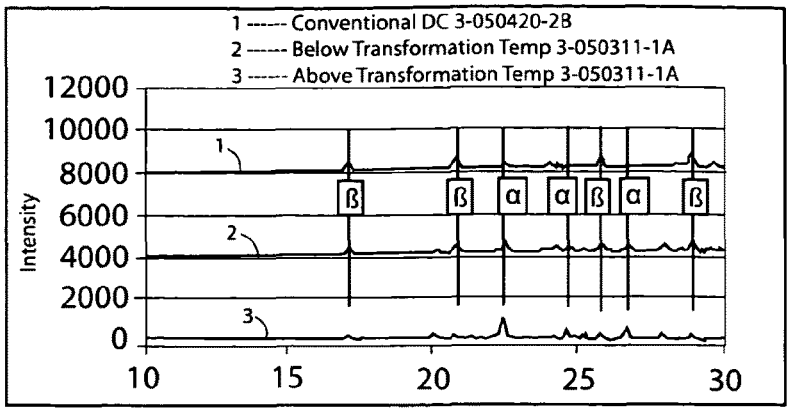
FIGS. 25*a*, 25*b* and 25*c* are each diffraction patterns of the alloy treated according to FIG. 23
Figure 25B:
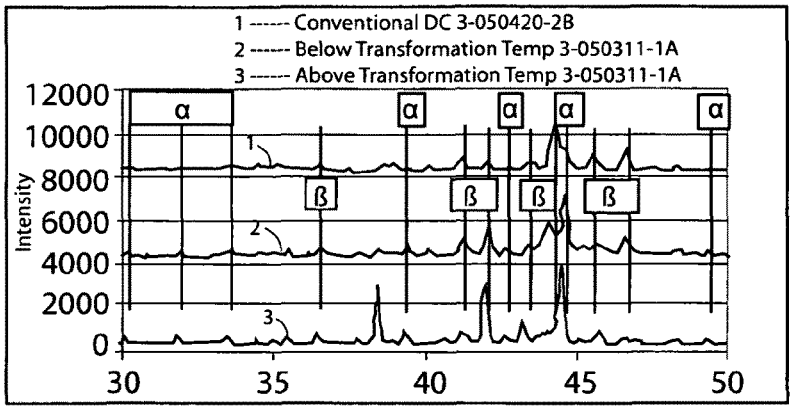
Figure 25C:
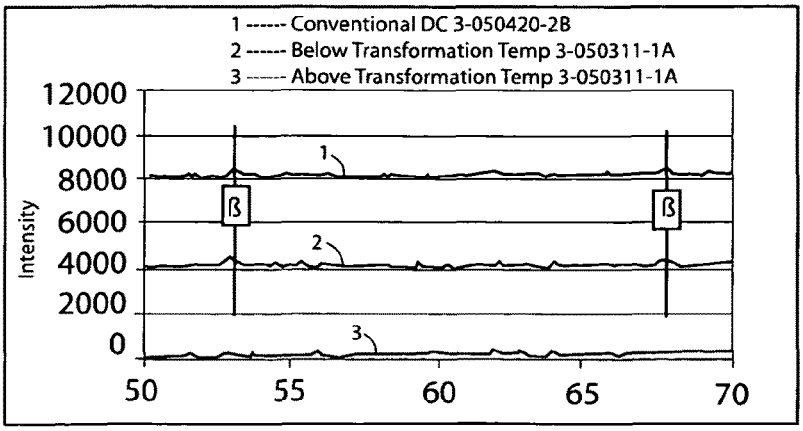

FIGS. 25*a*, 25*b* and 25*c* are X-Ray diffraction patterns taken from of 6063 alloy differentiating the amount of a and β phases contrasting conventional DC casting and two in-situ procedures of FIGS. 18 and 19. The upper trace of each figure represents a conventionally cast DC alloy, the middle trace represents a rebound temperature below the transformation temperature of the alloy, and the lower trace represents a rebound temperature above the transformation temperature of the alloy.

Comparative Example 4

Figure 26A:
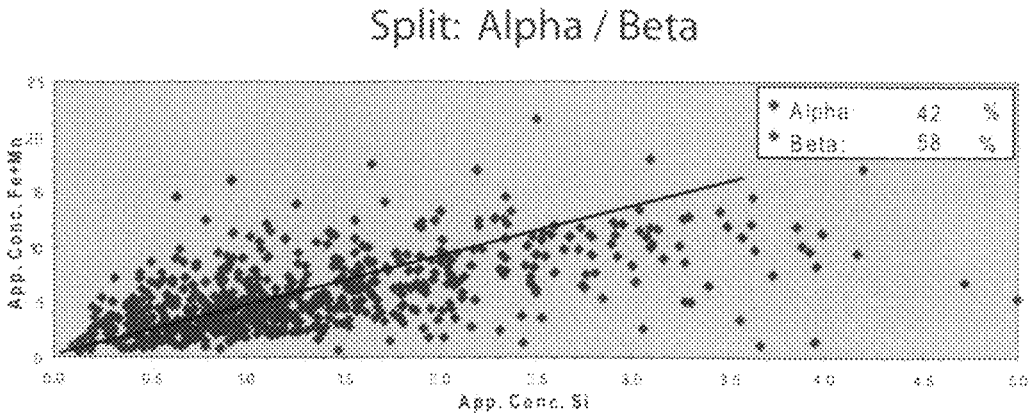
FIGS. 26*a*, 26*b* and 26*c* are each graphical representations of FDC techniques carried out on the ingots conventionally cast, and also treated according to the procedures of FIGS. 23 and 24.
Figure 26B:
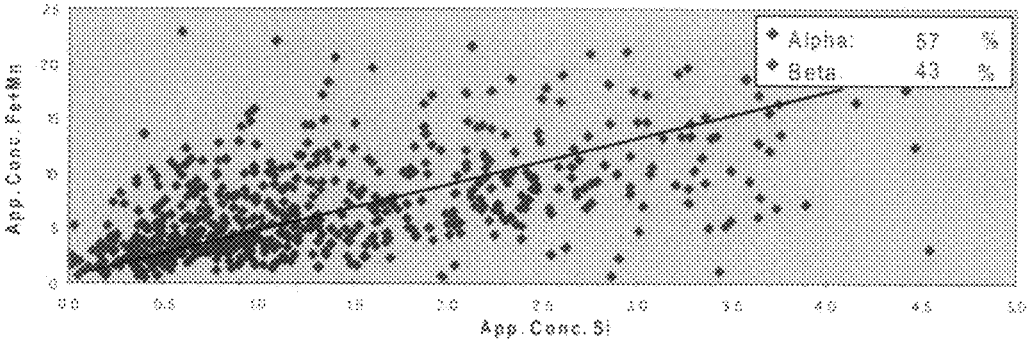
Figure 26C:
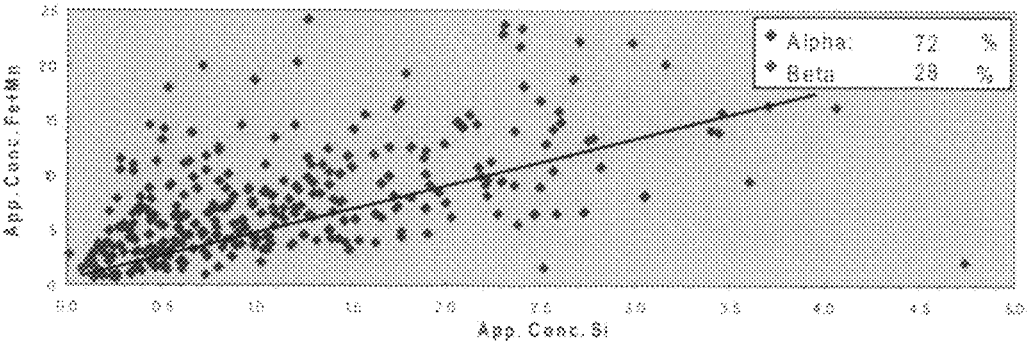

FIGS. 26*a*, 26*b* and 26*c* are graphical representations of FDC techniques in which FIG. 26*a* represents conventionally DC cast ingot, FIG. 26*b* represents the alloy of FIG. 23 and FIG. 26*c* represents the alloy of FIG. 24. The figures show an increase in the presence of the desirable α-phase as the rebound temperature passes the transformation temperature.

Incidentally, more information about both the FDC and SiBut/XRD techniques, as well as their application to the study of phase transformations, can be obtained from: "Intermetallic Phase Selection and Transformation in Aluminium 3xxx Alloys", by H. Cama, J. Worth, P. V. Evans, A. Bosland and J. M. Brown, Solidification Processing, Proceedings of the 4th Decennial International Conference on Solidification Processing, University of Sheffield, July 1997, eds J. Beech and H. Jones, p. 555 (the disclosure of which is incorporated herein by reference).

Example 4

Figure 27A:
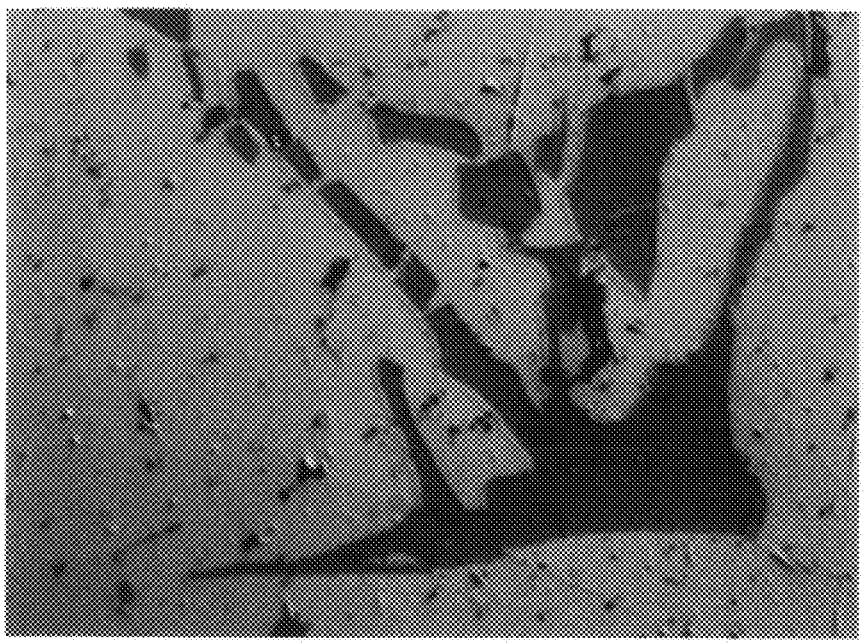
FIGS. 27*a* and 27*b* are optical photomicrographs of an as-cast intermetallic, Al-1.3% Mn alloy (AA3003) processed according to an exemplary embodiment, fractured.
Figure 27B:
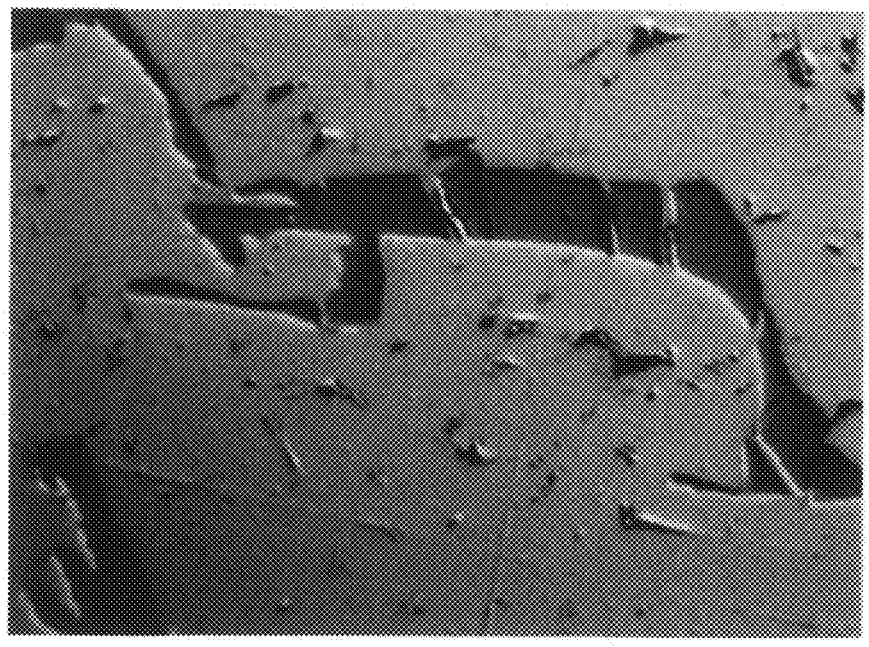

FIGS. 27*a* and 27*b* show two optical photomicrographs of a cast intermetallic, Al-1.3% Mn alloy (AA3003) processed according to the invention. It can be seen that the intermetallics (dark shapes in the figure) are cracked or fractured.

Figure 28:
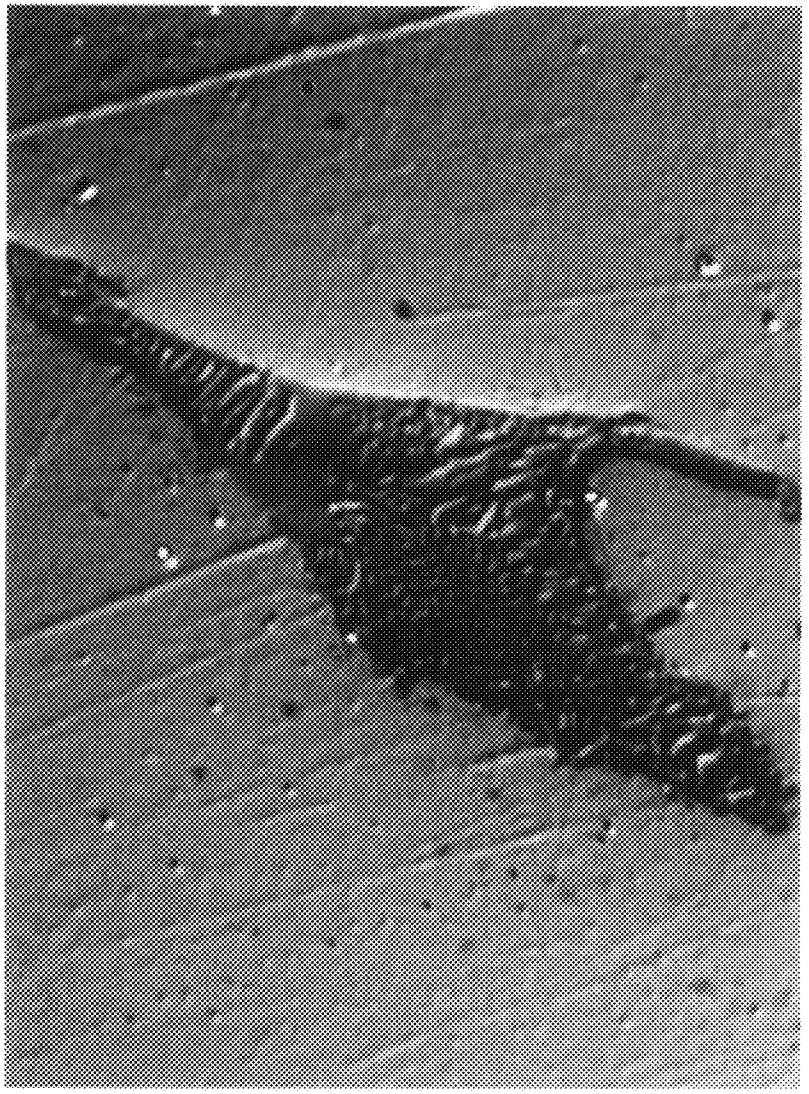
FIG. 28 is an optical photomicrograph of an as cast intermetallic, Al-1.3% Mn alloy processed according to an exemplary embodiment, modified.

FIG. 28 is an optical photomicrograph similar to those of FIGS. 27*a* and 27*b* again showing that the intermetallic is cracked or fractured. The large region of the particle is of $MnAl_6$. The ribbed features show Si diffusion into the intermetallic, forming AlMnSi.

Example 5

Figure 29:
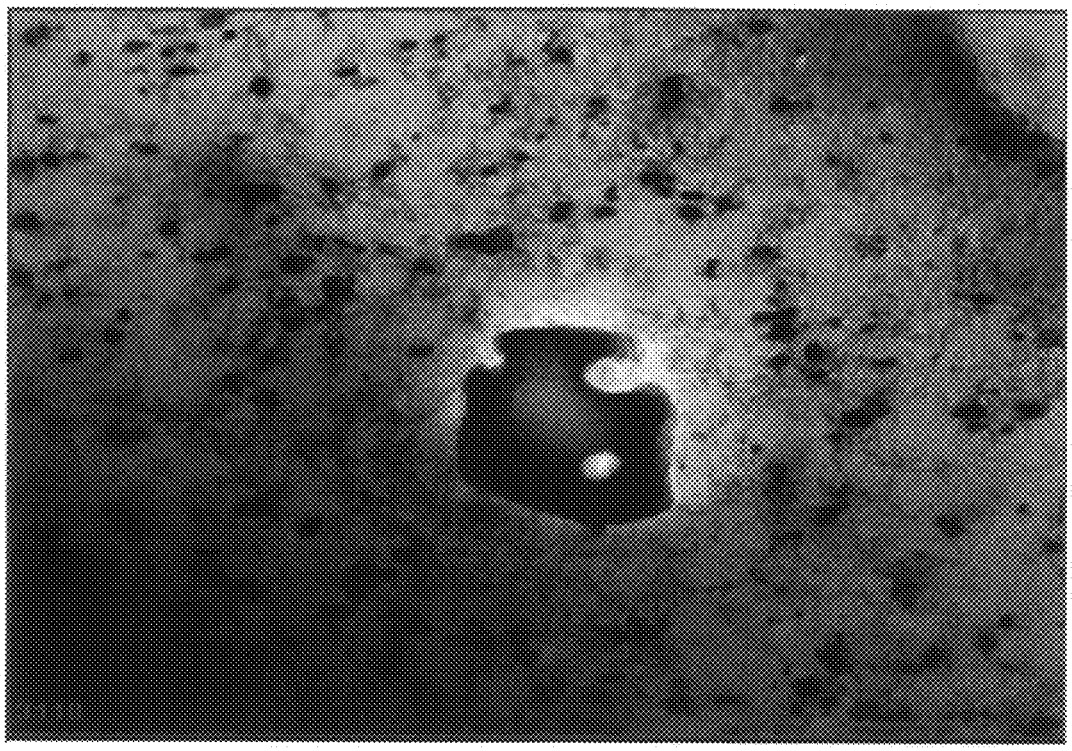
FIG. 29 is a transmission electron micrograph of as cast intermetallic phase, cast according to this exemplary embodiment, modified by diffusion of Si into the particle, showing a denuded zone.
Figure 31:
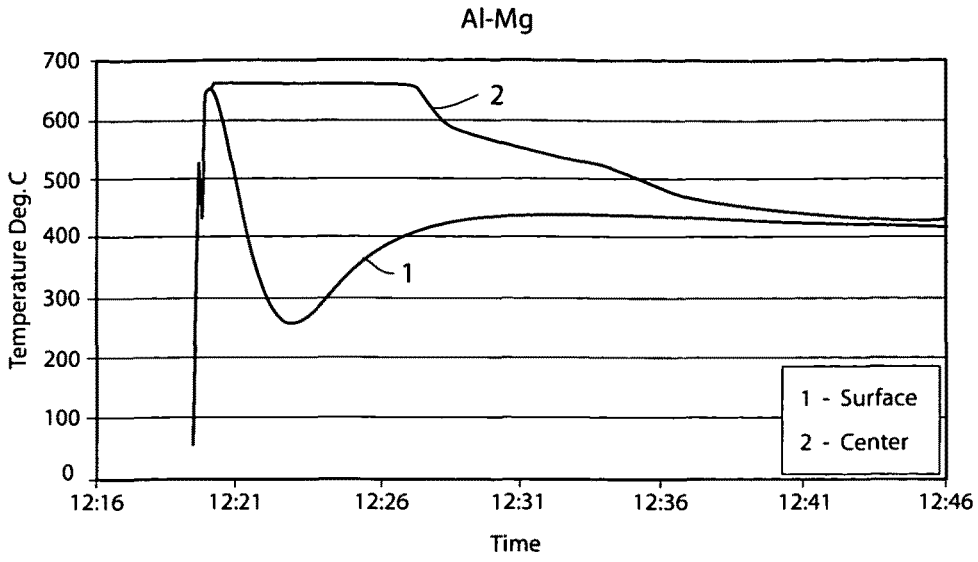
FIG. 31 is a graph illustrating the thermal history of an Al-7% Mg alloy in the region where solidification and reheat takes place in the case where the bulk of the ingot is not forcibly cooled with a rebound temperature which is below the dissolution temperature for the beta (β) phase.

FIG. 29 is a Transmission Electron Microscope TEM image of an as-cast intermetallic phase of an AA3104 alloy cast without a final quench, as shown in FIG. 31. The intermetallic phase is modified by diffusion of Si into the particle, showing a denuded zone. The sample was taken from the surface where the initial application of coolant nucleates particles. However, the rebound temperature modifies the particle and modifies the structure.

Comparative Example 5

Figure 30:
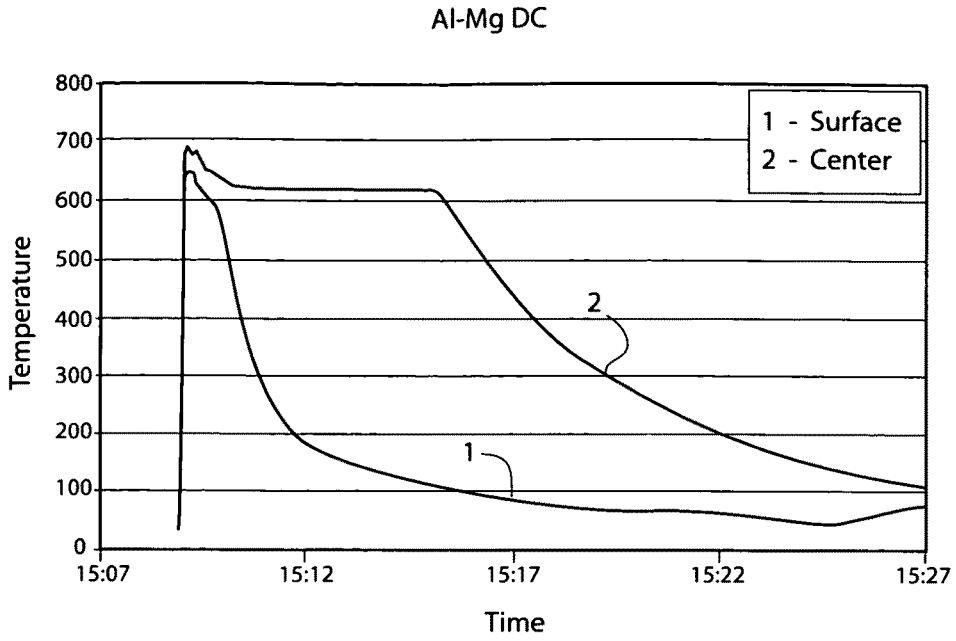
FIG. 30 is a graph illustrating the thermal history of an Al-7% Mg alloy conventionally processed.

FIG. 30 shows the thermal history of the Al-7% Mg alloy processed conventionally. It can be seen that there is no rebound of the shell temperature due to continued presence of coolant.

Figure 32:
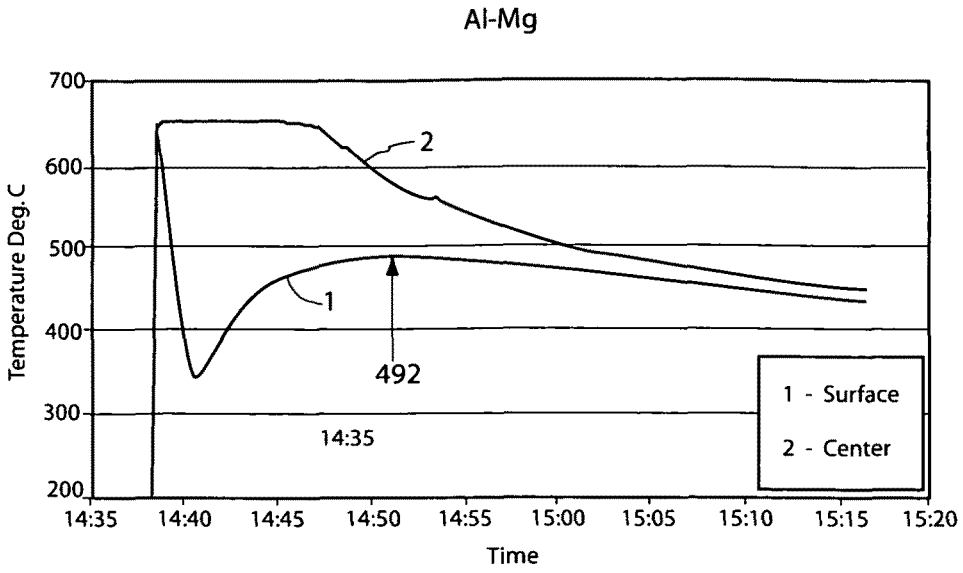
FIG. 32 is a graph illustrating the thermal history of an Al-7% Mg alloy in the region where solidification and reheat takes place in the case where the bulk of the ingot is not forcibly cooled with a rebound temperature which is above the dissolution temperature for the beta (β) phase.

FIGS. 31 and 32 show the thermal history of an Al-7% Mg alloy where the ingot is not cooled during the cast. This alloy forms the basis of FIG. 30.

Comparative Example 6

Figure 33:
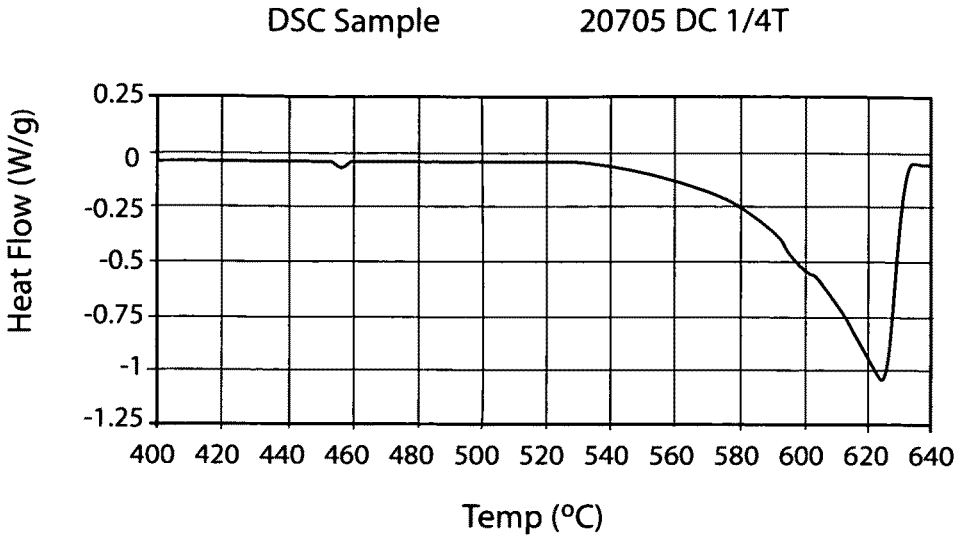
FIG. 33 is the output trace of a Differential Scanning Calorimeter (DSC) showing beta (β) phase presence in the 451-453° C. range (Conventionally Direct Chill Cast Material) (see FIG. 30)

FIG. 33 is a trace from a Differential Scanning Calorimeter (DSC) showing Beta (β) phase presence in the 450° C. range of the conventionally direct chill cast alloy which forms the basis of FIG. 30. The β-phase causes problems during rolling. The presence of the beta phase can be seen by the small dip in the trace just above 450° C. as heat is absorbed to convert β-phase to α-phase. The large dip descending to 620° C. represents melting of the alloy.

Figure 34:
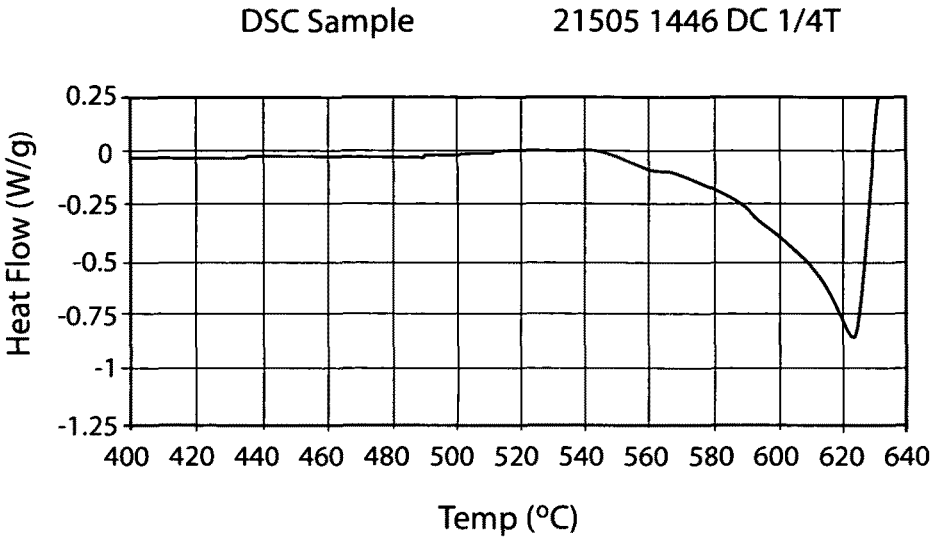
FIG. 34 is the output trace of a Differential Scanning Calorimeter (DSC) showing beta (β) phase absent) (see FIG. 31)

FIG. 34 is a trace similar to that of FIG. 33 showing the absence of Beta (β) phase in the material cast according to this invention where the ingot remains hot (no final quenching) during the cast (see FIG. 31).

Figure 35:
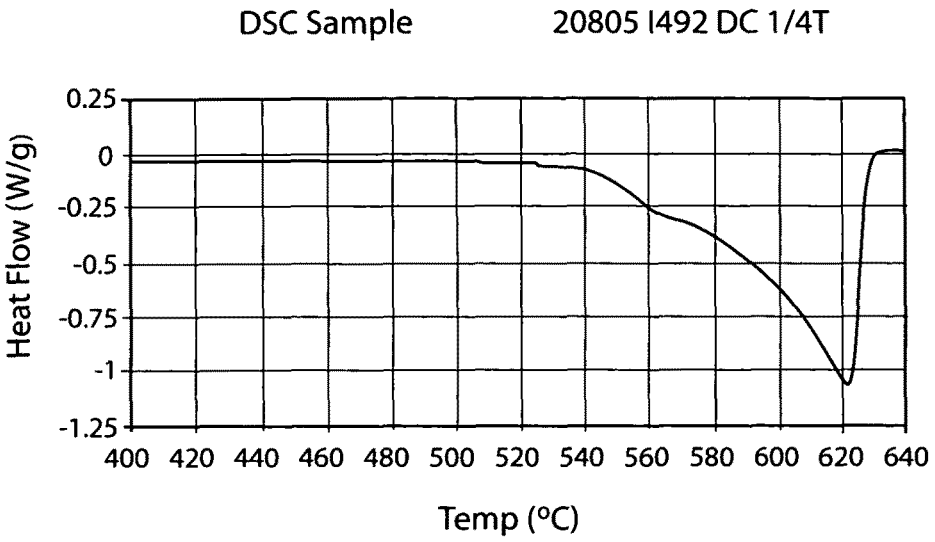
FIG. 35 is the output trace of a Differential Scanning calorimeter (DSC) trace showing beta (β) phase absent (see FIG. 32).

FIG. 35 is again a trace similar to that of FIG. 33 for the material cast according to this invention where the ingot remains hot (no final quenching) during the cast (see FIG. 32). Again, the trace shows an absence of Beta (β) phase.

What is claimed is:

1. A method of continuously or semi-continuously direct chill casting an ingot made of a castable metal, comprising the steps of:

(a) providing a direct chill casting mold having one or more mold inlets and one or more mold outlets;

(b) supplying molten metal to at least one inlet of the casting mold;

(c) cooling the mold to solidify a peripheral portion of the metal, thereby forming an embryonic ingot having an external solid shell and an internal molten core;

(d) continuously advancing the embryonic ingot beyond at least one outlet of the mold, thereby extending the molten core contained within the solid shell beyond said at least one outlet of the mold;

(e) cooling the embryonic ingot emerging from the mold to continue the solidification thereof by directing a supply of coolant liquid onto an outer surface of the embryonic ingot;

(f) causing said coolant liquid to be removed from the surface of the embryonic ingot before the ingot has been transformed into a fully solid ingot such that internal heat from the molten core reheats the solid shell adjacent to the core, thereby causing temperatures of said core and said shell to equilibrate at a convergence temperature, said coolant liquid being removed from said surface at a distance from said at least one mold outlet that causes said convergence temperature to be above a transformation temperature at which said metal undergoes in-situ homogenization;

(g) cooling said ingot or allowing said ingot to cool;

(h) with no intervening homogenization, pre-heating said ingot to a temperature effective for hot rolling; and (i) hot rolling said ingot;

wherein said pre-heating of step (h) is carried out in two steps, a first of which comprises heating said ingot to a nucleating temperature below said temperature effective for hot rolling and holding at said nucleating temperature for a time effective to cause nucleation within said ingot, and a second of which comprises heating said ingot from said nucleating temperature to said temperature effective for hot rolling, and maintaining said ingot at said temperature effective for hot rolling for a period of time to allow crystal growth before said hot rolling of step (i).

2. The method of claim 1, wherein said transformation temperature is 425° C. or higher.

3. A method of hot rolling an ingot produced by DC casting, comprising the steps of:

(a) quenching an ingot produced by direct chill casting from an elevated casting temperature;

(b) pre-heating said ingot to a temperature effective for hot rolling; and (c) hot rolling said ingot at said temperature effective for hot rolling;

wherein said pre-heating of step (b) is carried out in two steps, a first step comprising heating said ingot to a nucleating temperature below said temperature effective for hot rolling and holding at said nucleating temperature for a time effective to cause nucleation within said ingot, and a second step comprising heating said ingot from said nucleating temperature to said temperature effective for hot rolling, and maintaining said ingot at said temperature effective for hot rolling for a period of time to allow crystal growth before said hot rolling of step (c).

4. The method of claim 3, wherein said first step comprises heating said ingot to a temperature in the range of 380 to 450° C.

5. The method of claim 3, wherein said temperature in said first step is held for a period of 2 to 4 hours.

6. The method of claim 3, wherein said ingot is heated to said nucleating temperature at an average rate of about 50° C. per hour.

7. The method of claim 3, wherein said second step comprises heating said ingot to a temperature in the range of 480 to 550° C.

8. The method of claim 7, wherein said temperature in said second step is held for a period of time that extends a period of the entire pre-heating step into a range of 10 to 24 hours.

9. The method of claim 7, wherein said ingot is heated from said nucleating temperature to said temperature effective for hot rolling at a rate of about 50° C. per hour.

* * * * *